US010295921B2

(12) United States Patent
Ohmori et al.

(10) Patent No.: US 10,295,921 B2
(45) Date of Patent: May 21, 2019

(54) TONER

(71) Applicant: CANON KABUSHIKI KAISHA, Tokyo (JP)

(72) Inventors: Atsuhiko Ohmori, Yokohama (JP); Shuhei Moribe, Mishima (JP); Koji Nishikawa, Susono (JP); Kosuke Fukudome, Tokyo (JP); Daisuke Yoshiba, Suntou-gun (JP); Hiroyuki Tomono, Numazu (JP); Shotaro Nomura, Suntou-gun (JP); Sho Kimura, Kashiwa (JP); Tatsuya Saeki, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/843,137

(22) Filed: Dec. 15, 2017

(65) Prior Publication Data

US 2018/0173126 A1 Jun. 21, 2018

(30) Foreign Application Priority Data

Dec. 21, 2016 (JP) ..... 2016-247458
Nov. 7, 2017 (JP) ..... 2017-214362

(51) Int. Cl.
*G03G 9/087* (2006.01)
*G03G 9/09* (2006.01)

(52) U.S. Cl.
CPC ..... *G03G 9/08788* (2013.01); *G03G 9/08711* (2013.01); *G03G 9/08755* (2013.01);
(Continued)

(58) Field of Classification Search
CPC ..... G03G 9/08788; G03G 9/08797; G03G 9/08795; G03G 9/0904; G03G 9/08755; G03G 9/08711
See application file for complete search history.

(56) References Cited

U.S. PATENT DOCUMENTS 6,875,549 B2 4/2005 Yamazaki et al.
6,881,527 B2 4/2005 Moribe et al.
(Continued)

FOREIGN PATENT DOCUMENTS

JP 2007-086459 4/2007
JP 2016-066017 4/2016
JP 2016-130797 7/2016

OTHER PUBLICATIONS

U.S. Appl. No. 15/840,404, Kosuke Fukudome, filed Dec. 13, 2017.

*Primary Examiner* — Thorl Chea
(74) *Attorney, Agent, or Firm* — Venable LLP

(57) ABSTRACT

A toner comprising a toner particle containing a resin and a colorant, wherein, with respect to a temperature-storage elastic modulus curve obtained by powder dynamic viscoelastic measurement on the toner, (I) the relative minimum values for the variation in the storage elastic modulus E' with respect to temperature T in the temperature range of at least 30° C. and not more than 180° C. have a relative minimum value of equal to or less than $-1.00\times10^{7}$ and the relative minimum value on the lowest temperature side is equal to or less than $-1.00\times10^{8}$; (II) the storage elastic modulus E' (50) of the toner at 50° C. is at least $1.00\times10^{9}$ and not more than $9.00\times10^{9}$; and (III) for a storage elastic modulus E' (120) of the toner at 120° C., E' (50) and E' (120) satisfy $1.50\leq[E'(50)]/[E'(120)]\leq3.00$.

11 Claims, 1 Drawing Sheet

(52) U.S. Cl.
CPC ..... *G03G 9/08795* (2013.01); *G03G 9/08797* (2013.01); *G03G 9/0904* (2013.01)

(56) References Cited

U.S. PATENT DOCUMENTS

| | | | |
|---|---|---|---|
| 7,267,919 | B2 | 9/2007 | Moribe et al. |
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,537,877 | B2 | 5/2009 | Yoshiba et al. |
| 7,544,455 | B2 | 6/2009 | Yoshiba et al. |
| 7,582,401 | B2 | 9/2009 | Ogawa et al. |
| 7,638,251 | B2 | 12/2009 | Yamazaki et al. |
| 7,700,254 | B2 | 4/2010 | Moribe et al. |
| 7,740,998 | B2 | 6/2010 | Yamazaki et al. |
| 7,745,089 | B2 | 6/2010 | Okubo et al. |
| 7,796,926 | B2 | 9/2010 | Matsuda et al. |
| 7,855,042 | B2 | 12/2010 | Kobori et al. |
| 7,897,316 | B2 | 3/2011 | Yamazaki et al. |
| 8,026,030 | B2 | 9/2011 | Moribe et al. |
| 8,057,977 | B2 | 11/2011 | Moribe et al. |
| 8,227,162 | B2 | 7/2012 | Sano et al. |
| 8,426,094 | B2 | 4/2013 | Magome et al. |
| 8,501,377 | B2 | 8/2013 | Takahashi et al. |
| 8,512,925 | B2 | 8/2013 | Moribe et al. |
| 8,614,044 | B2 | 12/2013 | Matsui et al. |
| 8,778,585 | B2 | 7/2014 | Matsui et al. |
| 8,883,389 | B2 | 11/2014 | Matsui et al. |
| 9,034,549 | B2 | 5/2015 | Shiotari et al. |
| 9,040,216 | B2 | 5/2015 | Fukudome et al. |
| 9,097,997 | B2 | 8/2015 | Nomura et al. |
| 9,097,998 | B2 | 8/2015 | Yamazaki et al. |
| 9,116,448 | B2 | 8/2015 | Terauchi et al. |
| 9,128,400 | B2 | 9/2015 | Takahashi et al. |
| 9,134,637 | B2 | 9/2015 | Hotta et al. |
| 9,141,012 | B2 | 9/2015 | Moribe et al. |
| 9,152,065 | B2 | 10/2015 | Sano et al. |
| 9,201,323 | B2 | 12/2015 | Nishikawa et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,239,528 | B2 | 1/2016 | Hasegawa et al. |
| 9,250,548 | B2 | 2/2016 | Nomura et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,341,970 | B2 | 5/2016 | Yoshiba et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,594,323 | B2 | 3/2017 | Fujikawa et al. |
| 9,606,462 | B2 | 3/2017 | Nomura et al. |
| 9,715,188 | B2 | 7/2017 | Terauchi et al. |
| 9,772,570 | B2 | 9/2017 | Tsuda et al. |
| 9,829,818 | B2 | 11/2017 | Yoshiba et al. |
| 2004/0110076 | A1 | 6/2004 | Yamazaki et al. |
| 2004/0131961 | A1* | 7/2004 | Watanabe ..... G03G 9/0806 430/108.4 |
| 2006/0160007 | A1* | 7/2006 | Kmiecik-Lawrynowicz ..... G03G 9/0804 430/108.3 |
| 2009/0117481 | A1* | 5/2009 | Yasunaga ..... G03G 9/081 430/108.7 |
| 2012/0270145 | A1* | 10/2012 | Sakamoto ..... G03G 9/0804 430/105 |
| 2013/0252167 | A1 | 9/2013 | Moribe et al. |
| 2013/0309603 | A1 | 11/2013 | Takahashi et al. |
| 2014/0004460 | A1 | 1/2014 | Yoshiba et al. |
| 2015/0125790 | A1 | 5/2015 | Hotta et al. |
| 2015/0185658 | A1 | 7/2015 | Wakabayashi et al. |
| 2015/0220013 | A1 | 8/2015 | Nishikawa et al. |
| 2016/0139522 | A1* | 5/2016 | Yoshiba ..... G03G 9/08755 430/109.4 |
| 2016/0161874 | A1 | 6/2016 | Yamazaki et al. |
| 2016/0202624 | A1 | 7/2016 | Nishikawa et al. |
| 2017/0160661 | A1 | 6/2017 | Suzumura et al. |
| 2017/0199475 | A1 | 7/2017 | Fukudome et al. |
| 2018/0004109 | A1 | 1/2018 | Matsui et al. |

* cited by examiner

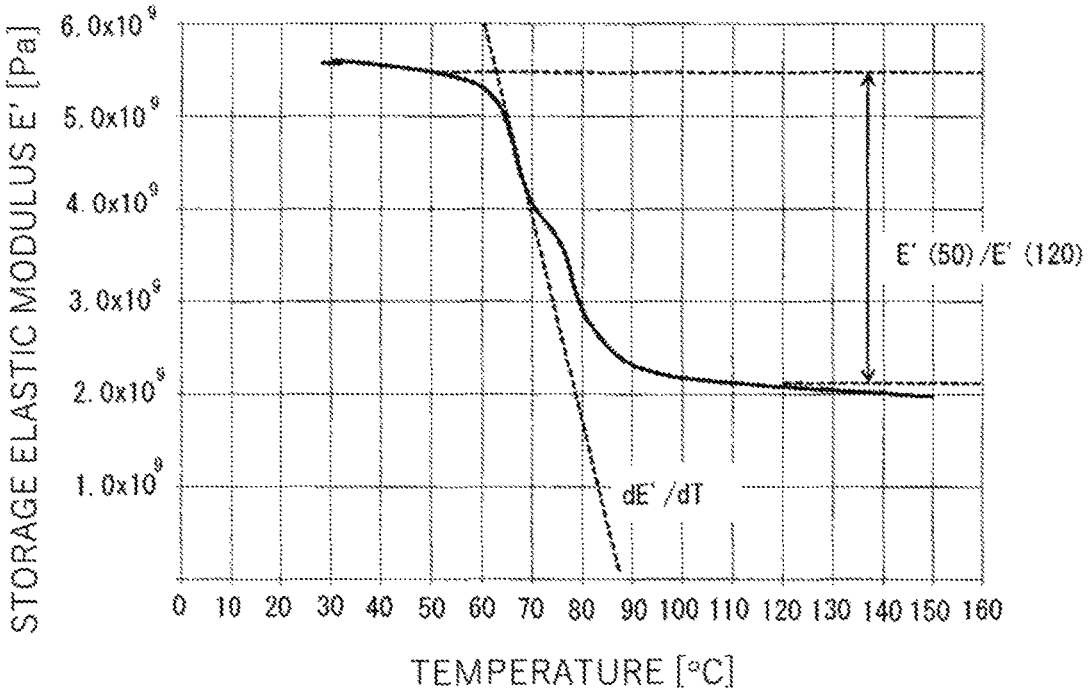
STORAGE ELASTIC MODULUS E' [Pa]
6.0x10^9
5.0x10^9
4.0x10^9
3.0x10^9
2.0x10^9
1.0x10^9
E' (50)/E' (120)
dE'/dT
0 10 20 30 40 50 60 70 80 90 100 110 120 130 140 150 160
TEMPERATURE [°C]

TONER

BACKGROUND OF THE INVENTION

Field of the Invention

The present invention relates to a toner used in, for example, electrophotographic methods, electrostatic recording methods, and magnetic recording methods.

Description of the Related Art

Image-forming apparatuses such as copiers and printers have been subject in recent years to a diversification of their intended uses and use environments as well as increased demands for higher print speeds and greater energy savings. For example, printers, which previously were used mainly in offices, have also entered into use in high-temperature and/or high-humidity environments, and providing a stable image quality even in such environments has thus become a matter of importance.

On the other hand, as print speeds increase, the time for passage through the fixing unit is shortened and as a result, for the same set temperature at the fixing unit, the amount of heat received by the toner is reduced. Reductions in the fixation temperature are also being sought from the standpoint of energy savings. That is, there is demand for a toner having an excellent low-temperature fixability.

In order to enhance the low-temperature fixability, the toner preferably undergoes sharp melting within the fixing nip, and as a consequence a design is sought in which, for example, softness is imparted to the binder resin. However, it has been found that when the low-temperature fixability of a toner is improved, the graininess of the halftone image becomes a problem.

The graininess in the halftone image referred to here is the density nonuniformity caused by the generation of differences in the degree of toner melting between depressions and protrusions in the paper surface. The toner at protrusions in the paper surface undergoes excessive melting due to the large amount of heat received in the fixing nip and the toner is then excessively liquefied. For toner in depressions, on the other hand, a smaller amount of heat is received in the fixing nip and as a consequence the toner undergoes an appropriate degree of melting. As a result, differences in the degree of toner melting are generated between the depressions and protrusions in paper and, with halftone images with their lower toner laid-on levels on the paper, the density nonuniformity becomes substantial and the halftone image graininess worsens.

In particular, when a sharp melt behavior is imparted to the toner in order to accommodate high-speed machines, the toner undergoes excessive liquefaction at protrusions on the paper surface and as a consequence an additional deterioration in the halftone image graininess is facilitated.

In addition, during long-term use in a high-temperature, high-humidity environment, a decline in toner flowability occurs due to the frequent rubbing received by the toner in the developing nip, where the developing sleeve is in contact with the developing blade. Because the toner is not adequately charged in the developing nip as a result, the dot reproducibility for the halftone image then declines and a trend is assumed of further deterioration in the graininess of the halftone image. Moreover, printers have recently begun to be used for light-duty printing service where high image quality is required (print-on-demand applications that support various types of low-volume printing, from document editing on computers to copying and book production), and the requirements on image quality on a wide range of paper types are thus increasing.

With regard to halftone images in the case of electrophotographic image-forming apparatuses, the latent image is realized through the formation of a collection of dots of a certain potential on the surface of the latent image bearing member and through variations in the dot density. Due to this, one method that can be contemplated for improving the graininess of halftone images is to improve the halftone image graininess by carrying out image formation with the dot size being reduced using the settings at the main printer unit. However, there are limits with this method on the improvement in halftone image graininess. In particular, there are strong requirements in the light-duty printing market on image quality and for increased printer speeds, and there is still room for improvement with regard to satisfying both the low-temperature fixability and halftone image graininess.

In another vein, with the object of enabling the low-temperature fixability to coexist in balance with the heat-resistant storability, Japanese Patent Application Laid-open No. 2016-66017 discloses art in which a crystalline material is incorporated in the toner and the compatibility between the crystalline material and amorphous material before and after melting is controlled.

With the object of enabling the low-temperature fixability to coexist in balance with properties such as the heat-resistant storability, but without using a crystalline material, Japanese Patent Application Laid-open No. 2007-86459 discloses a toner in which a linear component and a cross-linked component are co-incorporated in the toner and a functional separation is brought about.

Japanese Patent Application Laid-open No. 2016-130797 discloses a toner that uses a binder resin that brings about a reduction in the negative effects on the low-temperature fixability; this is achieved by having a uniform crosslinked structure for the binder resin present in the toner.

SUMMARY OF THE INVENTION

However, when the low-temperature fixability is improved by the methods described in the patent literature indicated above, during long-term use in a high-temperature, high-humidity environment the crystalline material, or the linear component, present in the toner compatibilizes into the resin and an improvement in the halftone image graininess is not seen and there is thus room for improvement.

The present invention provides a toner that, even when subjected to long-term use in a high-speed machine in a high-temperature, high-humidity environment, exhibits an excellent low-temperature fixability and an excellent halftone image graininess over a broad range of media.

The present invention is a toner comprising a toner particle containing a binder material and a colorant, wherein, in a temperature T-storage elastic modulus E' curve obtained by powder dynamic viscoelastic measurement on the toner, (I) when the curve for the variation dE'/dT in the storage elastic modulus E' with respect to temperature T is obtained, this dE'/dT curve has a relative minimum values of equal to or less than $-1.00\times10^{7}$ in the temperature range of from 30° C. to 180° C., and, a relative minimum value on the lowest temperature side of the relative minimum values is equal to or less than $-1.00\times10^{8}$;

(II) the E' (50) is from $1.00\times10^9$ to $9.00\times10^9$ when the storage elastic modulus E' of the toner at 50° C. is represented by E' (50); and (III) the E' (50) and E' (120) satisfy the following formula (1) when the storage elastic modulus E' of the toner at 120° C. is represented by E' (120):

$$1.50\leq[E'(50)]/[E'(120)]\leq3.00 \quad (1).$$

The present invention can thus provide a toner that, even when subjected to long-term use in a high-speed machine in a high-temperature, high-humidity environment, exhibits an excellent low-temperature fixability and an excellent halftone image graininess over a broad range of media.

BRIEF DESCRIPTION OF THE DRAWINGS

The FIGURE is an example of a temperature-storage elastic modulus curve obtained by a powder dynamic viscoelastic measurement on a toner.

DESCRIPTION OF THE EMBODIMENTS

Unless specifically indicated otherwise, the phrases "at least XX and not more than YY" and "from XX to YY" that give a numerical value range indicate in the present invention a numerical value range that includes the lower limit and upper limit that are the end points.

Moreover, a monomer unit is featured by a mode of reaction by a monomer matter in polymer or resin.

The present inventors carried out focused investigations into a toner that, even when subjected to long-term use in a high-speed printer in a high-temperature, high-humidity environment, would exhibit an excellent low-temperature fixability and an excellent halftone image graininess over a wide range of media.

To date, the following have been adopted in order to improve the low-temperature fixability: the incorporation in toner of a crystalline material, and a structural design in which a functional separation is achieved by the co-incorporation in the toner of a linear component and a crosslinked component.

However, it has been found that just the simple co-incorporation of these components, while being able to realize improvements in the low-temperature fixability, is problematic with regard to improving the halftone image graininess over a wide range of media.

As a result of investigations into the causes of the deterioration in halftone image graininess with toner having such a constitution, it was found that the toner at protrusions on the paper undergoes excessive melting and a large melting unevenness for the toner is then produced by the unevenness of the paper, and as a consequence the halftone image graininess deteriorates.

The present inventors therefore sought to refine the crosslinked component present in the toner and thereby control the melting condition of the toner at the protrusions on paper. However, microseparation between the linear component and crosslinked component cannot be prevented by simply refining the crosslinked component, and the linear component promotes plasticization of the toner during long-term use in a high-temperature, high-humidity environment.

When, during long-term use in a high-temperature, high-humidity environment, the toner undergoes plasticization due to rubbing at the developing nip, the halftone image graininess is then degraded due to a decline in toner flowability.

Getting this result, the present inventors then carried out additional investigations with regard to the binder material, e.g., a resin. It was discovered as a result that—by bringing about the formation of a unified network structure by dispersing the linear component and crosslinked component at the molecular level and concomitant therewith causing both to become physically entangled with each other—a toner can be provided that exhibits an excellent low-temperature fixability and an excellent halftone image graininess.

When such a network structure is formed, the decline in toner flowability during long-term use in a high-temperature, high-humidity environment is suppressed and excessive melting is inhibited, but without reducing the low-temperature fixability in high-speed machines, and the low-temperature fixability can then coexist in good balance with the halftone image graininess.

That is, the toner of the present invention is a toner having a toner particle containing a binder material and a colorant, wherein, in the temperature T [° C.]-storage elastic modulus E' [Pa] curve obtained by powder dynamic viscoelastic measurement on the toner, (I) when the curve for the variation dE'/dT in the storage elastic modulus E' with respect to temperature T is obtained, this dE'/dT curve have relative minimum values of equal to or less than $-1.00\times10^7$ in the temperature range of from 30° C. to 180° C., and, a relative minimum value on the lowest temperature side of the relative minimum values is equal to or less than $-1.00\times10^8$;

(II) the E' (50) is at least $1.00\times10^9$ and not more than $9.00\times10^9$ when the storage elastic modulus E' of the toner at 50° C. is represented by E' (50); and (III) the E' (50) and E' (120) satisfy the following formula (1) when the storage elastic modulus E' of the toner at 120° C. is represented by E' (120):

$$1.50\leq[E'(50)]/[E'(120)]\leq3.00 \quad (1).$$

The powder dynamic viscoelastic measurement method used on the toner in the present invention is described below.

Since the toner is measured in a particulate state when a powder dynamic viscoelastic measurement method is used, the initial variation in the obtained storage elastic modulus E' correlates with the low-temperature fixability in a high-speed machine. In addition, the use of this measurement method can quantify the motion of the toner surface layer, which could not be measured using previous dynamic viscoelastic measurements.

Attention was therefore directed to the temperature-storage elastic modulus curve (horizontal axis: temperature T [° C.], vertical axis: storage elastic modulus E' [Pa]) obtained by powder dynamic viscoelastic measurement of the toner, as shown in the FIGURE.

It was discovered that by controlling the numerical values indicated below in this curve, the low-temperature fixability of the toner could be made to coexist in good balance with the halftone image graininess, even during long-term use in a high-speed machine in a high-temperature, high-humidity environment.

(A) in the curve for the variation in the storage elastic modulus E' with respect to temperature T (dE'/dT in the FIGURE), the relative minimum value that first appears on the low temperature side in the temperature range of at least 30° C. and not more than 180° C.

(B) the overall variation, i.e., E' (50)/E' (120) in the FIGURE

The present inventors believe that the following points are important with regard to the coexistence of the aforementioned "low-temperature fixability" and "halftone image graininess".

(1-1) That rapid melting occurs in the neighborhood of the toner surface layer during passage through the fixing nip.

(1-2) That the toner not undergo excessive melting during passage through the fixing nip.

Both of these can be achieved by bringing about the formation of a network structure by the linear component and crosslinked component present in the binder material, e.g., a resin, that constitutes the toner and exercising a high degree of control on the viscoelasticity in the neighborhood of the toner surface layer and the viscoelasticity of the toner as a whole. The "low-temperature fixability" can be made to coexist in good balance with the "halftone image graininess" by achieving these simultaneously.

In the temperature range of at least 30° C. and not more than 180° C., the curve for dE'/dT for the temperature-storage elastic modulus curve obtained by powder dynamic viscoelastic measurement of the toner, has relative minimum values of equal to or less than $-1.00\times10^{7}$ and, of the relative minimum values that are equal to or less than $-1.00\times10^{7}$, the relative minimum value on the lowest temperature side (referred to below as the relative minimum value on the lowest temperature side) is equal to or less than $-1.00\times10^{8}$. The dE'/dT curve preferably has a plurality of relative minimum values of equal to or less than $-1.00\times10^{7}$. The relative minimum value on the lowest temperature side is preferably equal to or less than $-1.10\times10^{8}$ and is more preferably equal to or less than $-1.15\times10^{8}$. The relative minimum value on the lowest temperature side is preferably $-2.00\times10^{8}$ or more.

The relative minimum value on the lowest temperature side of this (dE'/dT curve) can be controlled using the following: the amount of linear component in the binder material incorporated in the toner; the amount of the plasticizing component in the case of the incorporation of another plasticizing component that plasticizes resins; and the physical entanglement of the linear component with the crosslinked component of the binder material.

By controlling the relative minimum value on the lowest temperature side in this (dE'/dT curve) into the range indicated above, rapid melting in the neighborhood of the toner surface layer can be brought about during passage through the fixing nip. It was discovered that, because measurement is carried out on the toner in powder form for the relative minimum value on the lowest temperature side in (dE'/dT), the viscoelasticity in the neighborhood of the toner surface layer corresponds to the rate of variation in the storage elastic modulus E' seen at the lowest temperature side in the temperature range of at least 30° C. and not more than 180° C.

Moreover, since the passage time through the fixing nip in a high-speed printer is extremely short, the viscoelasticity in the neighborhood of the toner surface layer strongly correlates with the low-temperature fixability. The low-temperature fixability in high-speed printers can then be improved based on this. That is, the aforementioned condition (1-1) can be satisfied by controlling the relative minimum value on the lowest temperature side in the (dE'/dT curve) into the range given above.

Here, when the relative minimum value in the (dE'/dT curve) on the lowest temperature side is greater than $-1.00\times10^{8}$, this means that the melting speed in the neighborhood of the toner surface layer is slower than for the toner of the present invention. Since a small amount of heat is received by the toner in the fixing nip in a high-speed printer, the melting speed in the neighborhood of the toner surface layer is an important factor for the low-temperature fixability. Due to this, the low-temperature fixability in high-speed printers is reduced when the melting speed in the neighborhood of the toner surface layer is larger than $-1.00\times10^{8}$. In addition, in the case of long-term use in a high-temperature, high-humidity environment, the linear component in the binder material outmigrates to the toner surface and the toner surface layer region is plasticized and in combination therewith a declining trend in toner flowability appears. In particular, toner having a good low-temperature fixability frequently contains a large amount of linear component, and the plasticization of the toner surface layer region and the loss of flowability can then become substantial during long-term use in a high-temperature, high-humidity environment.

In addition, using E' (50) for the storage elastic modulus E' of the toner at 50° C. as obtained by powder dynamic viscoelastic measurement, E' (50) is at least $1.00\times10^{9}$ and not more than $9.00\times10^{9}$.

This E' (50) is preferably at least $2.30\times10^{9}$ and not more than $8.00\times10^{9}$ and is more preferably at least $3.00\times10^{9}$ and not more than $6.00\times10^{9}$. E' (50) can be controlled using the amount of linear component and amount of crosslinked component in, and the physical strength of, the binder material contained in the toner.

The E' (50) obtained by powder dynamic viscoelastic measurement corresponds to the storage elastic modulus of the toner surface layer region during long-term use in a high-temperature, high-humidity environment. By controlling this E' (50) into the indicated range, plasticization of the toner surface layer region is suppressed and reductions in the flowability—as well as the amount of variation in the storage elastic modulus of the neighborhood of the toner surface layer during passage through the fixing nip—can be controlled into favorable ranges. By doing this, in the case of long-term use in a high-temperature, high-humidity environment, plasticization of the toner surface layer region can be suppressed and reductions in the dot reproducibility of the halftone image and deterioration of the halftone image graininess can be suppressed.

Thus, when E' (50) is less than $1.00\times10^{9}$, during long-term use in a high-temperature, high-humidity environment, plasticization of the neighborhood of the toner surface layer readily advances and, due to the decline in toner flowability, the dot reproducibility declines and the halftone image graininess deteriorates.

When, on the other hand, E' (50) is greater than $9.00\times10^{9}$, the storage elastic modulus E' in the neighborhood of the toner surface layer is high and, for the amount of heat applied to the toner in the fixing nip, cannot be lowered to a storage elastic modulus E' sufficient for fixing the neighborhood of the toner surface layer to paper, and the low-temperature fixability is then reduced.

In addition, with regard to the toner at protrusions on the paper in halftone images, this toner undergoes excessive melting due to the large amount of heat received by the toner in the fixing nip and the halftone image graininess then assumes a deteriorating trend. In the case, in particular, of rough paper having a large surface unevenness, a large difference occurs between the degree of melting of the toner at protrusions and the degree of melting of the toner at depressions, and due to this the halftone image graininess assumes a deteriorating trend.

The ratio of the storage elastic modulus E' of the toner at 50° C. [E' (50)] to the storage elastic modulus E' of the toner at 120° C. [E' (120)] therefore satisfies the following formula (1).

$$1.50 \leq E'(50)/E'(120) \leq 3.00 \quad (1)$$

This [E' (50)/E' (120)] is preferably at least 1.55 and not more than 2.45 and is more preferably at least 1.60 and not more than 2.15.

The E' (120) provided by powder dynamic viscoelastic measurement corresponds to the storage elastic modulus of the toner at protrusions on the paper when the toner passes through the fixing nip in a high-temperature, high-humidity environment.

[E' (50)/E' (120)] indicates the amount of variation in the storage elastic modulus E' of the toner pre-versus-post-passage of the toner through the fixing nip in an environment of long-term use in a high-temperature, high-humidity environment. This [E' (50)/E' (120)] can be controlled using the content of insoluble matter upon extraction with an organic solvent.

Excessive melting by the toner at protrusions on the paper can be suppressed by controlling this [E' (50)/E' (120)] into the indicated range. By doing this, excessive melting by the toner at protrusions on the paper can be suppressed and the halftone graininess can be improved even for rough paper exhibiting a large unevenness.

As a result, the aforementioned conditions (1-1) and (1-2) can be satisfied and the halftone image graininess on rough paper and the low-temperature fixability can be made to coexist in good balance during long-term use in a high-temperature, high-humidity environment.

When [E' (50)/E' (120)] is less than 1.50, this indicates that there is little change with melting in the neighborhood of the toner surface layer in the fixing nip.

That is, when [E' (50)/E' (120)] is less than 1.50, the degree of melting in the neighborhood of the toner surface layer in the fixing nip of a high-speed printer does not lower the viscosity to a melt viscosity sufficient for fixing to paper and the low-temperature fixability is reduced.

When, on the other hand, [E' (50)/E' (120)] is greater than 3.00, the melting change in the neighborhood of the toner surface layer in the fixing nip is too large and as a consequence the toner undergoes excessive melting and the halftone image graininess is degraded.

A toner that satisfies the aforementioned (1-1) and (1-2) provides an improved low-temperature fixability in high-speed printers by providing rapid melting of the neighborhood of the toner surface layer in the fixing nip. On the other hand, even during long-term use in a high-temperature, high-humidity environment, this toner does not undergo excessive melting at protrusions on the paper and can thus provide an enhanced dot reproducibility and an improved halftone image graininess.

Letting E" (120) be the loss elastic modulus E" of the toner at 120° C. as obtained by powder dynamic viscoelastic measurement, this E"(120) is preferably at least $7.50\times10^{7}$ and not more than $1.00\times10^{9}$ and is more preferably at least $8.50\times10^{7}$ and not more than $9.00\times10^{8}$.

By controlling this E" (120) into the indicated range, the spreading due to wetting when the toner melts can be restrained. As a result, the spreading due to wetting when the toner undergoes excessive melting can be restrained and the halftone image graininess can be improved.

This E"(120) can be adjusted based on the physical entanglement of the linear component with the crosslinked component in the binder material.

Letting α [mass %] be the content of the ethyl acetate-insoluble matter of the binder material after extraction for 18 hours when the toner is subjected to Soxhlet extraction using ethyl acetate, this α, considered with regard to the total mass of the binder material, is preferably at least 18.0 mass % and not more than 30.0 mass % and is more preferably at least 24.0 mass % and not more than 28.0 mass %.

Ethyl acetate has an ester group and is highly polar and can therefore extract high-polarity components that similarly have an ester group. Extraction of nonpolar components, on the other hand, is almost completely absent.

The amount of high-polarity component in the linear component present in the binder material of the toner can be measured by measurement of the content of the ethyl acetate-insoluble matter.

Because the ethyl acetate-soluble linear component plasticizes the binder material in a high-temperature, high-humidity environment, having the content of the ethyl acetate-insoluble matter in the binder material satisfy the indicated range can suppress plasticization of the toner and reductions in toner flowability during long-term use in a high-temperature, high-humidity environment.

The dot reproducibility of the halftone image can be further enhanced and the halftone image graininess can be further improved by this suppression of reductions in toner flowability.

The content of ethyl acetate-insoluble matter can be adjusted through the monomer composition and production conditions for the polar segment, e.g., the ester group, constituting the binder material, and by changing the toner production conditions.

Letting β [mass %] be the content of the tetrahydrofuran (THF)-insoluble matter of the binder material after extraction for 18 hours when the toner is subjected to Soxhlet extraction using tetrahydrofuran, this β, considered with regard to the total mass of the binder material, is preferably at least 4.0 mass % and not more than 10.0 mass % and is more preferably at least 5.0 mass % and not more than 8.0 mass %.

THF contains the furan ring and can elute both the polar linear component as well as the nonpolar linear component, and as a consequence it can elute most of the linear component in the binder material. Due to this, the content of the THF-insoluble matter in the binder material gives the content of the crosslinked component in the binder material.

Melt deformation of the toner when heat is applied to the toner can be suppressed by having the content of THF-insoluble matter be in the indicated range. As a result, excessive melting by the toner at protrusions on the paper can be suppressed and the halftone image graininess can then be further improved.

The content of this THF-insoluble matter can be adjusted through the monomer composition and production conditions used for the crosslinked component of the binder material and by changing the toner production conditions.

Letting α mass % be the content of the ethyl acetate-insoluble matter of the binder material after extraction for 18 hours when the toner is subjected to Soxhlet extraction using ethyl acetate, and letting β mass % be the content of the tetrahydrofuran-insoluble matter of the binder material after extraction for 18 hours when the toner is subjected to Soxhlet extraction using tetrahydrofuran, α and β preferably satisfy the following formula (2) and more preferably satisfy the following formula (2)'.

$$15.0\leq(\alpha-\beta)\leq25.0 \quad (2)$$

$$17.0\leq(\alpha-\beta)\leq23.0 \quad (2)'$$

As indicated above, since THF has a higher elution power than ethyl acetate, components that are soluble in ethyl acetate also dissolve in THF. Due to this, the (α−β) in formula (2) gives the content of THF-soluble matter in the ethyl acetate-insoluble matter in the binder material.

By satisfying formula (2), the plasticization of the toner surface by the linear component in the binder material present in the toner can be suppressed during long-term use in a high-temperature, high-humidity environment. This means that the exposure of high-polarity linear component onto the toner surface can be suppressed by reducing the linear component soluble in high-polarity ethyl acetate. As a result, the plasticization of the toner surface layer region by the high-polarity linear component can be suppressed even during long-term use in a high-temperature, high-humidity environment. Moreover, by having the binder material present in the toner have at least a certain content of THF-soluble linear component, plasticization of the neighborhood of the toner surface layer can be brought about when heat is received in the fixing nip. The preceding makes it possible to improve the low-temperature fixability without causing a decline in toner flowability even during long-term use in a high-temperature, high-humidity environment.

This ($\alpha-\beta$) can be controlled using the monomer composition and production conditions for the polar segment, e.g., the ester group, constituting the binder material, the monomer composition and production conditions used for the crosslinked component of the binder material, and the toner production conditions.

Considering the binder material present in a toner that satisfies this ($\alpha-\beta$), the linear component and crosslinked component in the binder material form a network structure in which they are either partially or completely entangled with each other.

The network structure referred to here is also known as an interpenetrating network structure and is a type of polymer blend and preferably has multiple network structures in which different types of blended polymers are partially or completely entangled with each other.

Heretofore known resins, e.g., polyester resins, vinyl resins, epoxy resins, and polyurethane resins can be used as the binder material.

While examples are provided below with regard to features for bringing about the presence of the aforementioned network structure, there is no limitation to these examples.

In a preferred example, the binder material comprises a resin composition A and a resin composition B; the softening point of the resin composition B is at least 20° C. lower than the softening point of the resin composition A; and the mass ratio of the resin composition A to the resin composition B (resin composition A/resin composition B) is at least 30/70 and not more than 70/30.

The softening point of the resin composition B is more preferably at least 30° C. lower than the softening point of the resin composition A. The upper limit for the value provided by subtracting the softening point of the resin composition B from the softening point of the resin composition A is preferably about not more than 60° C.

The mass ratio of the resin composition A to the resin composition B (resin composition A/resin composition B), on the other hand, is more preferably at least 35/65 and not more than 65/35.

The fixing region can be broadened by using two resin compositions having different softening points. In addition, preferably at least one of the resin composition A and the resin composition B contains a resin having the polyester structure. That at least one of the resin composition A and the resin composition B contains a resin having the polyester structure is preferred from the standpoint of the coexistence of the developing performance with the low-temperature fixability. The reason for this is as follows: by having the resin contain a polyester structure, polymer-to-polymer interactions then operate based on the polarity of the ester groups in the resin and exposure of the linear component in the toner at the toner surface is suppressed even during use in a high-temperature, high-humidity environment and the low-temperature fixability can be improved without reducing the developing performance.

Preferably the resin composition A contains

[I] a polyester resin having in terminal at least one of the following residues (also referred to in the following as the long-chain alkyl component A, which also includes the aliphatic hydrocarbon of [II] below): an alcohol residue from a long-chain alkyl monoalcohol having an average number of carbons of at least 27 and not more than 50 (preferably at least 30 and not more than 40), and a carboxylic acid residue from a long-chain alkyl monocarboxylic acid having an average number of carbons of at least 27 and not more than 50 (preferably at least 30 and not more than 40), and

[II] an aliphatic hydrocarbon having an average number of carbons of at least 27 and not more than 50; and the total content of the aliphatic hydrocarbon and the residue in the resin composition A is at least 2.5 mass % and not more than 10.0 mass % (more preferably at least 3.5 mass % and not more than 7.5 mass %) with respect to the total mass of the resin composition A.

The alcohol residue from a long-chain alkyl monoalcohol having an average number of carbons of at least 27 and not more than 50 refers to the group yielded by the elimination of the hydrogen atom from the hydroxy group of a long-chain alkyl monoalcohol having an average number of carbons of at least 27 and not more than 50. It is formed, for example, by the condensation of such a long-chain alkyl monoalcohol with the carboxy group in a polyester.

The carboxylic acid residue from a long-chain alkyl monocarboxylic acid having an average number of carbons of at least 27 and not more than 50 refers to the group yielded by the elimination of the hydrogen atom from the carboxy group of a long-chain alkyl monocarboxylic acid having an average number of carbons of at least 27 and not more than 50. It is formed, for example, by the condensation of such a long-chain alkyl monocarboxylic acid with the hydroxy group in a polyester.

The linear component readily becomes entangled with the crosslinked component when the resin composition A contains the long-chain alkyl component A at the resin terminals and in the resin composition. Due to this, the long-chain alkyl component A is preferably incorporated in the resin composition A at a high reaction percentage. The peak temperature (melting point) of the maximum endothermic peak of the long-chain alkyl component A is preferably at least 70° C. and not more than 80° C.

The average number of carbons in the long-chain alkyl component is determined by the following method in the present invention.

The distribution of the number of carbons in the long-chain alkyl component is measured by gas chromatography (GC) proceeding as follows.

10 mg of the sample is exactly weighed out and is introduced into a sample vial. 10 g of exactly weighed hexane is added to the sample vial, which is then closed with the lid, and mixing is carried out with heating to 150° C. on a hot plate.

The sample is then quickly injected into the injection port of the gas chromatograph so as to avoid precipitation of the long-chain alkyl component, and analysis is performed using the measurement instrumentation and measurement conditions described below.

A chart is obtained using the number of carbons for the horizontal axis and signal intensity for the vertical axis. The area of the peak for the component at each number of carbons is then calculated as a percentage with respect to the total area of all the detected peaks, and this is used as the occurrence ratio (area %) for the particular hydrocarbon compound. A carbon number distribution chart is constructed by using the number of carbons for the horizontal axis and the occurrence ratio (area %) for the hydrocarbon compounds on the vertical axis.

The number of carbons at the peak top in the carbon number distribution chart is taken to be the average number of carbons.

The measurement instrumentation and measurement conditions are as follows.

GC: 6890GC, HP Inc.

column: ULTRA ALLOY-1 P/N: UA1-30M-0.5F (Frontier Laboratories Ltd.)

carrier gas: He oven: (1) hold for 5 minutes at a temperature of 100° C., (2) ramp up to a temperature of 360° C. at 30° C./min, (3) hold for 60 minutes at a temperature of 360° C.

injection port: temperature of 300° C.

initial pressure: 10.523 psi split ratio: 50:1 column flow rate: 1 mL/min

When the content of the aliphatic hydrocarbon and residue (long-chain alkyl component A) in the resin composition A is at least 2.5 mass % and not more than 10.0 mass %, the linear component is then more readily entangled with the crosslinked component than for a structure in which the long-chain alkyl component A and resin are present separately. The halftone image graininess upon long-term use in a high-temperature, high-humidity environment is improved as a result.

With reference to the temperature-endothermic quantity curve obtained for the resin composition A by differential scanning calorimetric (DSC) measurement, preferably the peak temperature of the maximum endothermic peak occurs from 60.0° C. to 90.0° C. (preferably from 70° C. to 85° C.) and the endothermic quantity (ΔH) of this maximum endothermic peak is at least 0.10 J/g and not more than 1.90 J/g (preferably at least 0.30 J/g and not more than 1.80 J/g).

As noted above, in order to provide a toner that exhibits an excellent low-temperature fixability and in combination therewith an excellent halftone image graininess even during long-term use in a high-temperature, high-humidity environment, the amount of the free component that is unbonded to the resin composition A, i.e., the amount of unmodified long-chain alkyl component A (the aliphatic hydrocarbon in resin composition A for which the average number of carbons is at least 27 and not more than 50), must be optimized.

This unmodified long-chain alkyl component A displays a maximum endothermic peak in the temperature-endothermic quantity curve yielded by differential scanning calorimetric (DSC) measurement. By optimizing the endothermic quantity (ΔH) of this maximum endothermic peak, a toner can then be provided that exhibits an excellent low-temperature fixability and in combination therewith an even greater suppression of plasticization of the neighborhood of the toner surface layer during long-term use in a high-temperature, high-humidity environment and an even better halftone image graininess.

The occurrence of this endothermic quantity (ΔH) in the indicated range indicates that free long-chain alkyl component A is scarce, i.e., it is incorporated in the polyester resin.

The efficient incorporation of the long-chain alkyl component A in the polyester resin makes it possible to achieve an even greater suppression of the plasticization of the neighborhood of the toner surface layer during long-term use in a high-temperature, high-humidity environment.

The method for measuring the peak temperature and endothermic quantity (ΔH) of this endothermic peak is as follows.

The measurement is performed in accordance with ASTM D3418-82 using a "Q2000" differential scanning calorimeter (TA Instruments).

Temperature correction in the instrument detection section is carried out using the melting points of indium and zinc, and correction of the amount of heat is carried out using the heat of fusion of indium.

In specific terms, approximately 5 mg of the measurement sample is accurately weighed out and this is introduced into an aluminum pan; an empty aluminum pan is used as the reference.

The measurement is carried out in the measurement range of at least 30° C. and not more than 200° C. at a ramp rate of 10° C./min.

For the measurement, the temperature is first raised from 30° C. to 200° C. at a ramp rate of 10° C./min followed by cooling from 200° C. to 30° C. at a ramp down rate of 10° C./min.

This is followed by reheating from 30° C. to 200° C. at a ramp rate of 10° C./min.

The temperature-endothermic quantity curve (DSC curve) is obtained in the range from 30° C. to 200° C. in this second heating step.

The peak temperature is acquired for the maximum endothermic peak in the temperature-endothermic quantity curve from the second heating step. In addition, the endothermic quantity ΔH is the integrated value of the maximum endothermic peak.

The method for controlling the content of the unmodified long-chain alkyl component A, i.e., for controlling the endothermic quantity (ΔH), can be exemplified by methods in which the alcohol modification percentage or acid modification percentage of the aliphatic hydrocarbon is raised.

That is, with respect to the alcohol-modified or acid-modified long-chain alkyl component A, it is incorporated into the resin by reaction with the resin composition A in a polymerization reaction and an endothermic peak then does not appear in the DSC curve. The unmodified long-chain alkyl component A, on the other hand, is more resistant to compatibilization with resins than the bonded long-chain alkyl component A, and due to this it raises the endothermic quantity (ΔH).

Long-chain alkyl monoalcohols having an average number of carbons of at least 27 and not more than 50 and long-chain alkyl monocarboxylic acids having an average number of carbons of at least 27 and not more than 50 are obtained commercially by the alcohol or acid modification of aliphatic hydrocarbon starting materials.

The aliphatic hydrocarbon includes saturated hydrocarbons and unsaturated hydrocarbons and can be exemplified by alkanes, alkenes, alkynes, and cyclic hydrocarbons such as cyclohexane; however, it is preferably a saturated hydrocarbon (alkane).

For example, with respect to alcohol-modified products, an aliphatic hydrocarbon having at least 27 and not more than 50 carbons may be converted into the alcohol by liquid-phase oxidation with a molecular oxygen-containing gas in the presence of a catalyst such as boric acid, boric anhydride, or metaboric acid.

The amount of addition of the catalyst used is approximately 0.01 to 0.5 mol per 1 mol of the starting aliphatic hydrocarbon.

The molecular oxygen-containing gas injected into the reaction system can be, for example, oxygen or air or these diluted over a broad range with an inert gas; however, the oxygen concentration is preferably 3% to 20%. The reaction temperature preferably is at least 100° C. and not more than 200° C.

The endothermic quantity (ΔH) can be controlled by decreasing the unmodified aliphatic hydrocarbon component by optimizing the reaction conditions and/or by carrying out a purification step after the modification reaction.

The modification percentage is preferably at least 85% and more preferably at least 90%. The upper limit, on the other hand, is preferably approximately not more than 99%.

The long-chain alkyl monoalcohol preferably contains secondary alcohol as its major component. The presence of secondary alcohol as the major component indicates that at least 50 mass % of the long-chain alkyl monoalcohol is secondary alcohol.

The use of long-chain alkyl monoalcohol having secondary alcohol as its major component facilitates the assumption of a folded structure by the long-chain alkyl component. As a result, steric hindrance and so forth is inhibited and a more uniform occurrence of the long-chain alkyl component in the polyester resin composition is facilitated and greater physical entanglement by the linear component is supported.

The resin composition A preferably contains a hybrid resin that has a polyester segment and a vinyl polymer segment. In this case, the long-chain alkyl component A is preferably condensed in terminal position on the polyester segment of the hybrid resin.

Through the incorporation of a hybrid resin having a polyester segment, with its excellent melting characteristics, and a high-softening-point vinyl polymer segment, with its excellent charging characteristics, a resin composition is obtained that has an excellent charge stability and an excellent low-temperature fixability, while raising the softening point of the resin composition A. The image density stability in high-humidity environments and the low-temperature fixability are raised still further as a result.

The mass ratio of the polyester segment to vinyl polymer segment in the hybrid resin is preferably at least 80/20 and not more than 98/2 and is more preferably at least 85/15 and not more than 97/3.

When this range is observed, a low-temperature fixability that is stable regardless of the environment is exhibited while the advantages of the incorporation of the hybrid resin are obtained.

The vinyl polymer segment present in the hybrid resin preferably contains a monomer unit derived from a styrene monomer and a monomer unit derived from an acrylic acid monomer and/or a methacrylic acid monomer, and the content of the monomer unit derived from an acrylic acid monomer and/or a methacrylic acid monomer is preferably at least 80 mol % and not more than 95 mol % and more preferably at least 85 mol % and not more than 93 mol %, in each case with regard to the total monomer unit forming the vinyl polymer segment.

The low-temperature fixability can be improved by observing the indicated range. The reason for this is thought to be as follows: by incorporating in the resin composition A a monomer unit derived from an acrylic acid monomer and/or a methacrylic acid monomer, which has a low glass transition temperature, the low-temperature fixability can be improved without lowering the softening point of the crosslinked component in the resin composition A.

The polyester segment present in the hybrid resin preferably contains a monomer unit derived from an ethylene oxide adduct on bisphenol A, and the content of the monomer unit deriving from an ethylene oxide adduct on bisphenol A is preferably at least 10 mol % and not more than 50 mol % and more preferably at least 20 mol % and not more than 40 mol %, in each case with regard to the total monomer unit forming the polyester segment.

By observing the indicated range, the halftone image graininess can be improved even on highly uneven rough paper, but without impairing the low-temperature fixability. The reason for this is thought to be as follows: through, for example, the occurrence of a transesterification reaction between the alkyl acrylate ester of the vinyl polymer segment present in the resin composition A and a terminal hydroxyl group of the bisphenol A/ethylene oxide adduct present in the polyester segment, a uniform crosslinked structure is formed in the resin composition A and elasticity is obtained without raising the softening point.

On the other hand, preferably the resin composition B contains

[I] a polyester resin having in terminal at least one of the following residues (also referred to in the following as the long-chain alkyl component B, which also includes the aliphatic hydrocarbon of [II] below): an alcohol residue from a long-chain alkyl monoalcohol having an average number of carbons of at least 25 and not more than 102 (preferably at least 35 and not more than 80), and a carboxylic acid residue from a long-chain alkyl monocarboxylic acid having an average number of carbons of at least 25 and not more than 102 (preferably at least 35 and not more than 80), and

[II] an aliphatic hydrocarbon having an average number of carbons of at least 25 and not more than 102; and the total content of the aliphatic hydrocarbon and residue having an average number of carbons of at least 25 and not more than 102 in the resin composition B is at least 5.0 mass % and not more than 20.0 mass % (more preferably at least 6.0 mass % and not more than 15.0 mass %) with respect to the total mass of the resin composition B.

When the resin composition B contains the long-chain alkyl component B at the resin terminals and in the resin composition B, the softening point of the resin composition B can be lowered by a small amount of the long-chain alkyl component B and a plasticizing effect is rapidly exhibited during fixation. Due to this, the low-temperature fixability can be improved in high-speed printers.

Resin composition B preferably has a proportion for molecular weights equal to or less than 1,000, in the molecular weight distribution measured by gel permeation chromatography (GPC), preferably of not more than 10 mass % and more preferably of not more than 8.0 mass %.

By controlling the proportion for the molecular weights equal to or less than 1,000 into the indicated range, the glass transition temperature (Tg) can then be raised without changing the softening point of the resin composition B. By doing this, the low-Tg component in the toner is reduced and reductions in the toner flowability during long-term use in a high-temperature, high-humidity environment are suppressed still further and the dot reproducibility of halftone images and the image density can be improved still further.

The resin composition B preferably contains a monomer unit derived from ethylene glycol, and the proportion of the monomer unit derived from ethylene glycol, using 100 mol % for the total alcohol monomer unit that forms the polyester resin in the resin composition B, is preferably at least 15.00 mol % and not more than 30.00 mol % and is more preferably at least 18.00 mol % and not more than 25.00 mol %.

The resin composition B, by containing monomer unit derived from ethylene glycol in the proportion indicated above, can also be provided with flexibility originating with the linearity. As a result, the resin composition B can achieve both rigidity and flexibility and, through its physical entanglement with crosslinked structures, reductions in the toner flowability even during long-term use in a high-temperature, high-humidity environment can be suppressed and as a consequence the halftone image graininess can be improved.

The following compounds are examples of monomers that can constitute the polyester resin or the polyester segment.

The alcohol component can be exemplified by the following dihydric alcohols:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols given by the following formula (I) and their derivatives, and diols given by the following formula (II).

(I)

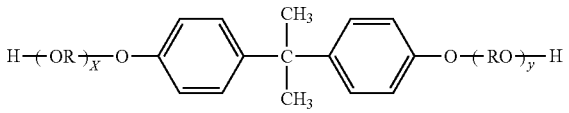

(In the formula, R represents an ethylene group or propylene group; X and Y are each integers equal to or greater than 0; and the average value of X+Y is at least 0 and not more than 10.)

(II)

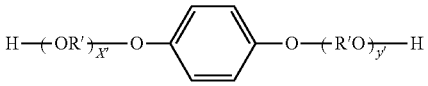

(In the formula, R' is

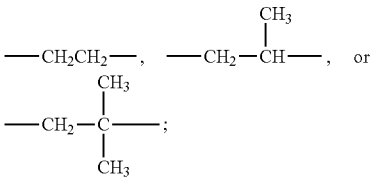

x' and y' are each integers equal to or greater than 0; and the average value of x'+y' is at least 0 and not more than 10.)

The following dibasic carboxylic acids are examples of the acid component:

benzenedicarboxylic acids and anhydrides thereof, e.g., phthalic acid, terephthalic acid, isophthalic acid, and phthalic anhydride; alkyl dicarboxylic acids, e.g., succinic acid, adipic acid, sebacic acid, and azelaic acid, and their anhydrides; succinic acid substituted by an alkyl group having at least 6 and not more than 18 carbons or by an alkenyl group having at least 6 and not more than 18 carbons, and anhydrides thereof; and unsaturated dicarboxylic acids, e.g., fumaric acid, maleic acid, citraconic acid, and itaconic acid, and anhydrides thereof.

Tribasic and higher basic polybasic carboxylic acids can be exemplified by 1,2,4-benzenetricarboxylic acid (trimellitic acid), 1,2,4-cyclohexanetricarboxylic acid, 1,2,4-naphthalenetricarboxylic acid, and pyromellitic acid and their anhydrides and lower alkyl esters.

Among the preceding, aromatic compounds, which are also stable to environmental fluctuations, are preferred, for example, 1,2,4-benzenetricarboxylic acid and its anhydrides.

The trihydric and higher hydric polyhydric alcohols can be exemplified by 1,2,3-propanetriol, trimethylolpropane, hexanetriol, and pentaerythritol.

The following compounds are examples of vinyl monomers that can constitute the vinyl polymer segment: styrene; styrene derivatives such as o-methylstyrene, methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; α-methylene aliphatic monocarboxylate esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylic acid and methacrylic acid derivatives such as acrylonitrile, methacrylonitrile, and acrylamide.

Additional examples are as follows: unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic acid anhydride; half esters of unsaturated dibasic acids, such as the methyl half ester of maleic acid, the ethyl half ester of maleic acid, the butyl half ester of maleic acid, the methyl half ester of citraconic acid, the ethyl half ester of citraconic acid, the butyl half ester of citraconic acid, the methyl half ester of itaconic acid, the methyl half ester of alkenylsuccinic acid, the methyl half ester of fumaric acid, and the methyl half ester of mesaconic acid; esters of unsaturated dibasic acids such as dimethyl maleate and dimethyl fumarate; α, β-unsaturated acids such as acrylic acid, methacrylic acid, and crotonic acid; the anhydrides of α, β-unsaturated acids such as crotonic anhydride and cinnamic anhydride; anhydrides between an α, β-unsaturated acid and a lower fatty acid; and carboxy group-bearing monomers such as alkenylmalonic acid, alkenylglutaric acid, and alkenyladipic acid and their anhydrides and monoesters.

Additional examples are acrylate and methacrylate esters such as 2-hydroxyethyl acrylate, 2-hydroxyethyl methacrylate, and 2-hydroxypropyl methacrylate, and hydroxy group-bearing monomers such as 4-(1-hydroxy-1-methylbutyl) styrene and 4-(1-hydroxy-1-methylhexyl)styrene.

The vinyl polymer segment of the hybrid resin may have a crosslinked structure provided by crosslinking with a crosslinking agent having two or more vinyl groups. The crosslinking agent used in this case can be exemplified by the following:

aromatic divinyl compounds (divinylbenzene, divinylnaphthalene); alkyl chain-linked diacrylate compounds (ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds provided by replacing the acrylate in the preceding compounds with methacrylate); diacrylate compounds in which linkage is effected by an alkyl chain that contains an ether linkage (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds provided by replacing the acrylate in the preceding compounds with methacrylate); diacrylate compounds in which linkage is effected by a chain that has an aromatic group and an ether linkage [polyoxyethylene(2)-2,2-bis(4-hydroxyphenyl)propane diacrylate, polyoxyethylene(4)-2,2-bis(4-hydroxyphenyl)propane diacrylate, and compounds provided by replacing the acrylate in the preceding compounds with methacrylate]; and polyester-type diacrylate compounds ("MANDA", Nippon Kayaku Co., Ltd.).

Polyfunctional crosslinking agents can be exemplified by the following: pentaerythritol triacrylate, trimethylolethane triacrylate, trimethylolpropane triacrylate, tetramethylolmethane tetraacrylate, oligoester acrylate, and compounds provided by replacing the acrylate in the preceding compounds with methacrylate, and also by triallyl cyanurate and triallyl trimellitate.

The quantity of addition of these crosslinking agents, per 100 mass parts of the monomer other than the crosslinking agent, is preferably at least 0.01 mass parts and not more than 10.00 mass parts and more preferably at least 0.03 mass parts and not more than 5.00 mass parts.

Among these crosslinking agents, aromatic divinyl compounds (particularly divinylbenzene) and diacrylate compounds in which linkage is effected by a chain that has an aromatic group and an ether linkage are examples of crosslinking agents that are advantageously used in polyester-containing resin compositions from the standpoint of the fixing performance and offset resistance.

Polymerization initiators used for the polymerization of the vinyl polymer segment can be exemplified by the following: 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2-azobis(2-methylpropane), ketone peroxides (e.g., methyl ethyl ketone peroxide, acetylacetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butyl cumyl peroxide, dicumyl peroxide, α,α'-bis(tert-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-toluoyl peroxide, diisopropyl peroxydicarbonate, di-2-ethylhexyl peroxydicarbonate, di-n-propyl peroxydicarbonate, di-2-ethoxyethyl peroxycarbonate, dimethoxyisopropyl peroxydicarbonate, di(3-methyl-3-methoxybutyl) peroxycarbonate, acetylcyclohexylsulfonylperoxide, tert-butyl peroxyacetate, tert-butyl peroxyisobutyrate, tert-butyl peroxyneodecanoate, tert-butyl peroxy-2-ethylhexanoate, tert-butyl peroxylaurate, tert-butyl peroxybenzoate, tert-butylperoxy isopropyl carbonate, di-tert-butylperoxyisophthalate, tert-butylperoxy allyl carbonate, tert-amyl peroxy-2-ethylhexanoate, di-tert-butyl peroxyhexahydroterephthalate, and di-tert-butyl peroxyazelate.

The hybrid resin preferably contains, in its vinyl polymer segment and/or polyester segment, a monomer component (a dual reactive monomer) capable of reacting with both components.

Among monomers that can constitute the polyester segment, monomers capable of reacting with the vinyl polymer segment can be exemplified by unsaturated dicarboxylic acids such as fumaric acid, maleic acid, citraconic acid, and itaconic acid and their anhydrides.

Among monomers that can constitute the vinyl polymer segment, monomers that can react with the polyester segment can be exemplified by monomers that have a carboxy group or hydroxy group, acrylic acid and methacrylic acid, and esters of the preceding.

In a preferred method for obtaining the reaction product of the vinyl polymer segment and polyester segment, the polymerization reaction of either component or both components is brought about in the presence of a polymer that contains dual reactive monomer.

This dual reactive monomer is considered to be monomer constituting the polyester segment in the discussion of the monomer content in the hybrid resin. This is because the dual reactive monomer has a greater influence on the properties of the condensation polymerized resin (polyester segment) when either a condensation polymerization reaction or an addition polymerization reaction is run in advance.

An embodiment in which the resin composition A contains a polyester resin as follows is also a preferred example.

A linear polyester is first obtained by the condensation polymerization of a dihydric alcohol with a dibasic carboxylic acid. The terminal position of the linear polyester is also modified by the addition of a monovalent terminal modification agent. A polyester resin is then obtained by adding a dihydric alcohol and a dibasic carboxylic acid and a trihydric or higher hydric alcohol or a tribasic or higher basic carboxylic acid and carrying out condensation polymerization.

There are no particular limitations on the terminal modification agent, and it can be exemplified by monobasic carboxylic acids, monohydric alcohols, and their derivatives. Monobasic aromatic carboxylic acid (benzoic acid) and/or derivatives thereof are an advantageous example.

There are no particular limitations on the toner production method, and heretofore known production methods can be used. A toner production method that proceeds through a melt-kneading step and a pulverization step is provided as a specific example in the following, but there is no limitation to this.

For example, the binder material and colorant and optionally a release agent, charge control agent, and other additives may be thoroughly mixed using a mixer such as a Henschel mixer or a ball mill (mixing step).

The resulting mixture may be melt-kneaded using a heated kneader such as a twin-screw kneader-extruder, hot roll, kneader, or extruder (melt-kneading step).

The resulting melt-kneaded material may be cooled and solidified and then pulverized using a pulverizer (pulverization step), followed by classification using a classifier (classification step) to obtain toner particles.

The toner particles may optionally also be mixed with an external additive using a mixer such as a Henschel mixer to obtain a toner.

The mixer can be exemplified by the following: Henschel mixer (Nippon Coke & Engineering. Co., Ltd.); Super Mixer (Kawata Mfg. Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The heated kneader can be exemplified by the following: KRC Kneader (Kurimoto, Ltd.); Buss Ko-Kneader (Buss AG); TEM Extruder (Toshiba Machine Co., Ltd.); TEX twin-screw kneader (The Japan Steel Works, Ltd.); PCM Kneader (Ikegai Ironworks Corporation); three-roll mills, mixing roll mills, and kneaders (Inoue Mfg., Inc.); Kneadex (Mitsui Mining Co., Ltd.); model MS pressure kneader and Kneader-Ruder (Moriyama Works); and Banbury mixer (Kobe Steel, Ltd.).

The pulverizer can be exemplified by the following: Counter Jet Mill, Micron Jet, and Inomizer (Hosokawa Micron Corporation); IDS mill and PJM Jet Mill (Nippon Pneumatic Mfg. Co., Ltd.); Cross Jet Mill (Kurimoto, Ltd.); Ulmax (Nisso Engineering Co., Ltd.); SK Jet-O-Mill (Seishin Enterprise Co., Ltd.); Kryptron (Kawasaki Heavy Industries, Ltd.); Turbo Mill (Turbo Kogyo Co., Ltd.); and Super Rotor (Nisshin Engineering Inc.).

The classifier can be exemplified by the following: Classiel, Micron Classifier, and Spedic Classifier (Seishin Enterprise Co., Ltd.); Turbo Classifier (Nisshin Engineering Inc.); Micron Separator, Turboplex (ATP), and TSP Separator (Hosokawa Micron Corporation); Elbow-Jet (Nittetsu Mining Co., Ltd.); Dispersion Separator (Nippon Pneumatic Mfg. Co., Ltd.); and YM Microcut (Yaskawa & Co., Ltd.).

In addition, a screening device as follows may be used to screen the coarse particles:

Ultrasonic (Koeisangyo Co., Ltd.), Rezona Sieve and Gyro-Sifter (Tokuju Corporation), Vibrasonic System (Dalton Corporation), Soniclean (Sintokogio, Ltd.), Turbo Screener (Turbo Kogyo Co., Ltd.), Microsifter (Makino Mfg. Co., Ltd.), and circular vibrating sieves.

The toner of the present invention may be used in the form of any of the following toners: magnetic single-component toner, nonmagnetic single-component toner, and nonmagnetic two-component toner.

A magnetic body is preferably used as the colorant in the case of use as a magnetic single-component toner.

The magnetic body can be exemplified by magnetic iron oxides, e.g., magnetite, maghemite, and ferrite, and magnetic iron oxides that contain another metal oxide, and by metals such as Fe, Co, and Ni, or alloys of these metals with metals such as Al, Co, Cu, Pb, Mg, Ni, Sn, Zn, Sb, Be, Bi, Cd, Ca, Mn, Se, Ti, W, and V, and their mixtures.

The shape of the magnetic body is preferably octahedral. The magnetic body takes on a good dispersibility when it has an octahedral shape.

The content of the magnetic body is preferably at least 40 mass parts and not more than 70 mass parts per 100 mass parts of the resin material.

The incorporation of an inorganic material such as a magnetic body can raise the viscosity of the neighborhood of the toner surface layer. As a result, reductions in toner flowability can be reduced during long-term use in a high-temperature, high-humidity environment and reductions in the dot reproducibility can also be prevented.

The colorant can be exemplified by the following, on the other hand, in the case of use as a nonmagnetic single-component toner or nonmagnetic two-component toner.

Black pigments can be exemplified by carbon blacks, e.g., furnace black, channel black, acetylene black, thermal black, and lamp black, and by magnetic bodies such as magnetite and ferrite.

The following pigments and dyes can be used as yellow colorants. The pigments can be exemplified by C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, and 191, and by C. I. Vat Yellow 1, 3, and 20.

The dyes can be exemplified by C. I. Solvent Yellow 19, 44, 77, 79, 81, 82, 93, 98, 103, 104, 112, and 162. A single one of these may be used or two or more may be used in combination.

The following pigments and dyes can be used as cyan colorants.

The pigments can be exemplified by C. I. Pigment Blue 1, 7, 15, 15:1, 15:2, 15:3, 15:4, 16, 17, 60, 62, and 66 and by C. I. Vat Blue 6 and C. I. Acid Blue 45.

The dyes can be exemplified by C. I. Solvent Blue 25, 36, 60, 70, 93, and 95. A single one of these may be used or two or more may be used in combination.

The following pigments and dyes can be used as magenta colorants.

The pigments can be exemplified by C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, and 254, and by C. I. Pigment Violet 19 and C. I. Vat Red 1, 2, 10, 13, 15, 23, 29, and 35.

The dyes can be exemplified by oil-soluble dyes such as C. I. Solvent Red 1, 3, 8, 23, 24, 25, 27, 30, 49, 52, 58, 63, 81, 82, 83, 84, 100, 109, 111, 121, and 122, C. I. Disperse Red 9, C. I. Solvent Violet 8, 13, 14, 21, and 27, and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40, and C. I. Basic Violet 1, 3, 7, 10, 14, 15, 21, 25, 26, 27, and 28. A single one of these may be used or two or more may be used in combination.

The colorant content, per 100 mass parts of the binder material, is preferably at least 0.1 mass parts and not more than 60 mass parts and more preferably at least 0.5 mass parts and not more than 50 mass parts. The toner may optionally use a release agent (wax) in order to provide releasability. Viewed in terms of the ease of dispersion in the toner and the extent of the releasability, the use is preferred for this wax of an aliphatic hydrocarbon wax.

The aliphatic hydrocarbon wax can be exemplified by the following: low molecular weight alkylene polymers provided by the radical polymerization of an alkylene under high pressures or provided by the polymerization of an alkylene at low pressures using a Ziegler catalyst; alkylene polymers obtained by the pyrolysis of high molecular weight alkylene polymer; synthetic hydrocarbon waxes obtained from the residual distillation fraction of hydrocarbon obtained by the Arge method from a synthesis gas containing carbon monoxide and hydrogen, and also the synthetic hydrocarbon waxes obtained by the hydrogenation of these synthetic hydrocarbon waxes; and waxes provided by the fractionation of the aforementioned aliphatic hydrocarbon waxes by a press sweating method, solvent method, use of vacuum distillation, or a fractional crystallization technique.

Hydrocarbons that are a source for aliphatic hydrocarbon waxes can be exemplified by the following: hydrocarbon synthesized by the reaction of carbon monoxide and hydrogen using a metal oxide catalyst (frequently a multicomponent system that is a binary or higher system) (for example, hydrocarbon compounds synthesized by the Synthol method or Hydrocol method (use of a fluidized catalyst bed)); hydrocarbon having up to about several hundred carbons, obtained by the Arge method (use of a fixed catalyst bed), which produces large amounts of waxy hydrocarbon; and hydrocarbon provided by the polymerization of an alkylene, e.g., ethylene, using a Ziegler catalyst.

The wax can be specifically exemplified by the following:

oxides of aliphatic hydrocarbon waxes, such as oxidized polyethylene wax, and their block copolymers; waxes in which the major component is fatty acid ester, such as carnauba wax, sasol wax, montanoic acid ester waxes; waxes provided by the partial or complete deacidification of a fatty acid ester, e.g., deacidified carnauba wax; saturated straight-chain fatty acids such as palmitic acid, stearic acid, and montanoic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; long-chain alkyl alcohols; polyhydric alcohols such as sorbitol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N-dioleylsebacamide; aromatic bisamides such as m-xylenebisstearamide and N,N-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinylic monomer such as styrene or acrylic acid; partial esters from a polyhydric alcohol and a fatty acid, such as behenic monoglyceride; and hydroxy group-containing methyl ester compounds obtained by the hydrogenation of plant oils.

The following are examples at a more specific level: VISCOL (registered trademark) 330-P, 550-P, 660-P, and TS-200 (Sanyo Chemical Industries, Ltd.); Hi-WAX 400P, 200P, 100P, 410P, 420P, 320P, 220P, 210P, and 110P (Mitsui Chemicals, Inc.); Sasol H1, H2, C80, C105, and C77 (Sasol Limited); HNP-1, HNP-3, HNP-9, HNP-10, HNP-11, and HNP-12 (Nippon Seiro Co., Ltd.); UNILIN (registered trademark) 350, 425, 550, and 700 and UNICID (registered trademark) 350, 425, 550, and 700 (Toyo Petrolite Co., Ltd.); and Japan Wax, Beeswax, Rice Wax, Candelilla Wax, and Carnauba Wax (Cerarica NODA Co., Ltd.). A single one of these may be used or two or more may be used in combination.

In order to efficiently obtain a release effect, the incorporation is preferred among the preceding of a release agent having a peak temperature of at least 100° C. for the maximum endothermic peak of the release agent.

With regard to the timing for release agent addition, in the case of toner production by the pulverization method, addition may be carried out during melt-kneading or during production of the binder material.

The release agent content is preferably at least 1 mass parts and not more than 20 mass parts per 100 mass parts of the binder material.

The toner may contain a charge control agent in order to stabilize its triboelectric charging behavior.

The content of the charge control agent, while also varying as a function of its type and the properties of the other constituent materials of the toner, is generally, per 100 mass parts of the binder material, preferably at least 0.1 mass parts and not more than 10 mass parts and more preferably at least 0.1 mass parts and not more than 5 mass parts.

Charge control agents that control the toner to a negative charging performance and charge control agents that control the toner to a positive charging performance are known for charge control agents, and a single one of the various charge control agents or two or more can be used depending on the toner type and application.

The following are examples of charge control agents for controlling the toner to a negative charging performance:

organometal complexes (monoazo metal complexes, acetylacetone metal complexes); the metal complexes and metal salts of aromatic hydroxycarboxylic acids and aromatic dicarboxylic acids; aromatic mono- and polycarboxylic acids and their metal salts and anhydrides; and phenol derivatives such as esters and bisphenols.

Preferred among the preceding are the metal complexes and metal salts of aromatic hydroxycarboxylic acids, which provide stable charging characteristics.

The following are examples of charge control agents for controlling the toner to a positive charging performance:

nigrosine and its modifications by fatty acid metal salts; quaternary ammonium salts such as tributylbenzylammonium 1-hydroxy-4-naphthosulfonate and tetrabutylammonium tetrafluoroborate, and their analogues; onium salts such as phosphonium salts, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanic acid, and ferrocyanic compounds); and metal salts of higher fatty acids.

Nigrosine compounds and quaternary ammonium salts, for example, are preferred among the preceding.

A charge control resin may also be used, and it may also be used in combination with the charge control agents cited above. Specific examples of the charge control agents are as follows:

Spilon Black TRH, T-77, T-95, and TN-105 (Hodogaya Chemical Co., Ltd.); BONTRON (registered trademark) S-34, S-44, E-84, and E-88 (Orient Chemical Industries Co., Ltd.); TP-302 and TP-415 (Hodogaya Chemical Co., Ltd.); BONTRON (registered trademark) N-01, N-04, N-07, and P-51 (Orient Chemical Industries Co., Ltd.); and Copy Blue PR (Clariant International Ltd,).

The toner may be used as a two-component developer by mixing with a carrier. An ordinary carrier, e.g., ferrite, magnetite, and so forth, or a resin-coated carrier may be used as the carrier. A binder-type carrier, in which a magnetic body is dispersed in a resin, may also be used.

Resin-coated carriers comprise a carrier core particle and a coating material, i.e., a resin, coated on the surface of the carrier core particle. The resins used for the coating material can be exemplified by styrene-acrylic resins such as styrene-acrylate ester copolymers and styrene-methacrylate ester copolymers; acrylic resins such as acrylate ester copolymers and methacrylate ester copolymers; fluororesins such as polytetrafluoroethylene, monochlorotrifluoroethylene polymers, and polyvinylidene fluoride; silicone resins; polyester resins; polyamide resins; polyvinyl butyral; and aminoacrylate resins. Additional examples are ionomer resins and polyphenylene sulfide resins. A single one of these resins may be used by itself or a plurality may be used in combination.

In a preferred embodiment of the toner, silica fine particles are added as an external additive to the toner particle in order to improve the developing performance durability, the flowability, and the durability.

The specific surface area of the silica fine particles by the BET method based on nitrogen adsorption is preferably at least 30 $m^2/g$ and is more preferably at least 50 $m^2/g$ and not more than 400 $m^2/g$. The silica fine particles are used, per 100 mass parts of the toner particle, at preferably at least 0.01 mass parts and not more than 8.00 mass parts and more preferably at least 0.10 mass parts and not more than 5.00 mass parts.

Using, for example, an Autosorb 1 specific surface area analyzer (Yuasa Ionics Co., Ltd.), a Gemini 2360/2375 (Micromeritics Instrument Corp.), or a TriStar 3000 (Micromeritics Instrument Corp.), the BET specific surface area of the silica fine particles may be determined using the BET multipoint method by carrying out the adsorption of nitrogen gas onto the surface of the silica fine particles.

With the objective of controlling the triboelectric charging performance, the silica fine particles are also optionally preferably treated with a treatment agent, e.g., unmodified silicone varnish, variously modified silicone varnishes, unmodified silicone oil, variously modified silicone oils, silane coupling agents, functional group-bearing silane compounds, and other organosilicon compounds, or with a combination of these treatment agents.

Other external additives may also be added to the toner on an optional basis. These external additives can be exemplified by resin fine particles and inorganic fine particles that act as, for example, charging auxiliaries, agents that provide conductivity, flowability-imparting agents, anticaking agents, release agents for hot roller fixation, lubricants, abrasives, and so forth. The lubricant can be exemplified by polyethylene fluoride powder, zinc stearate powder, and polyvinylidene fluoride powder. The abrasive can be exemplified by cerium oxide powder, silicon carbide powder, and strontium titanate powder, whereamong strontium titanate powder is preferred.

The methods for measuring the individual properties involved with the present invention are described in the following.

Method for Measuring the Powder Dynamic Viscoelasticity

A DMA 8000 (PerkinElmer Inc.) is used for the measurement instrument. A single cantilever (product number: N533-0300) is used for the measurements, and the measurements are carried out using an oven with product number: N533-0267.

First, approximately 50 mg of the toner is exactly weighed out and is introduced into the provided Material Pocket (product number: N533-0322) so the toner is in the center. The mounting fixture is then attached to the geometry shaft such that the mounting fixture straddles the temperature sensor and the distance between the drive shaft and the mounting fixture is 18.0 mm. Clamping with the mounting fixture is then carried out such that the center of the toner-loaded Material Pocket resides at the center between the mounting fixture and the drive shaft, and the measurement is performed.

The following measurement conditions are set for the measurement using the measurement wizard.

oven: Standard Air Oven
measurement type: temperature scan
deformation mode: single cantilever
frequency: single frequency, 1 Hz
amplitude: 0.05 mm
temperature ramp speed: 2° C./min
starting temperature: 30° C.
end temperature: 180° C.
cross section: rectangle
test specimen dimensions: length×width×thickness: 17.5 mm×7.5 mm×1.5 mm
data acquisition interval: 0.3 second interval With regard to the variation (dE'/dT) in the storage elastic modulus E' with respect to temperature T in the temperature T [° C.]-storage elastic modulus E' [Pa] curve yielded by powder dynamic viscoelastic measurement of the toner, the variation (dE'/dT) in E' with respect to temperature T is measured at 1.5 seconds before and after each temperature.

Using this method, the variation (dE'/dT) is determined in the temperature range of at least 30° C. and not more than 180° C.; a temperature [° C.]-variation (dE'/dT) graph is constructed by skipping two points from the initial data of the data for each plot; and the presence of a relative minimum value of equal to or less than $-1.00\times10^7$ is ascertained. In addition, of the relative minimum values of equal to or less than $-1.00\times10^7$, the relative minimum value of the variation (dE'/dT) in E' with respect to temperature T that appears first on the low temperature side is determined.

Method for Measuring the Content of Ethyl Acetate-Insoluble Matter Originating from the Binder Material Approximately 1.5 g of the toner is exactly weighed out (W1 [g]) and is introduced into a pre-weighed extraction thimble (product name: No. 86R, size 28×100 mm, Toyo Roshi Kaisha, Ltd.), and this is set into a Soxhlet extractor.

Extraction is carried out for 18 hours using 200 mL of ethyl acetate as the solvent. Extraction is run here at a reflux rate that provides an extraction cycle for the solvent of once in approximately 5 minutes.

After extraction is finished, the extraction thimble is removed and air dried followed by vacuum drying for 24 hours at 50° C. The mass of the extraction thimble containing the extraction residue is measured, and the mass (W2 [g]) of the extraction residue is calculated by subtracting the mass of the extraction thimble.

The content (W3, [g]) of the non-resin components is then determined using the following procedure.

Approximately 2 g of toner is exactly weighed (Wa [g]) into a pre-weighed 30-mL magnetic crucible.

The magnetic crucible is placed into an electric oven and heating is performed for about 3 hours at approximately 900° C.; cooling is carried out in the electric oven; cooling is carried out for at least 1 hour in a desiccator at normal temperature; the mass of the crucible containing the pyrolysis residue is measured; and the pyrolysis residue (Wb [g]) is determined by subtracting the mass of the crucible.

The mass (W3 [g]) of the pyrolysis residue in the sample W1 [g] is calculated using the following formula (A).

$$W3=W1\times(Wb/Wa) \quad \text{(A)}$$

In this case, the content of the ethyl acetate-insoluble matter in the binder material is calculated using the following formula (B).

$$\text{Ethyl acetate-insoluble matter in binder material} = \{(W2-W3)/(W1-W3)\}\times 100 \quad (B)$$

Method for Measuring the Content of Tetrahydrofuran (THF)-Insoluble Matter Originating with the Binder Material The content of THF-insoluble matter originating with the binder material is determined using the previously described "Method for measuring the content of ethyl acetate-insoluble matter originating from the binder material", but changing the solvent to THF.

Method for Measuring the Molecular Weight of the Resins, e.g., the Binder Material The molecular weight of the resins, e.g., the binder material, is measured as follows using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)
columns: 7-column train of Shodex KF-801, 802, 803, 804, 805, 806, and 807 (Showa Denko K.K.)
eluent: tetrahydrofuran (THF)
flow rate: 1.0 mL/min
oven temperature: 40.0° C.
sample injection amount: 0.10 mL The calibration curve used to determine the molecular weight of the sample is constructed using polystyrene resin standards (product name "TSK Standard Polystyrene F-850, F-450, F-288, F-128, F-80, F-40, F-20, F-10, F-4, F-2, F-1, A-5000, A-2500, A-1000, and A-500", Tosoh Corporation). The elution time at which the molecular weight reached 1,000 was calculated using this molecular weight calibration curve.

The solution before and the solution after the elution time for a molecular weight of 1,000 are collected.

The collected samples are held at quiescence for 48 hours at room temperature followed by thoroughly drying for 24 hours at 50° C. using a vacuum dryer. The masses of the dried samples are measured and the proportion for molecular weights equal to or less than 1,000 is calculated using the following formula.

proportion for molecular weights equal to or less than 1,000=(mass of the component with a molecular weight equal to or less than 1,000)/{(mass of the component with a molecular weight in excess of 1,000)+(mass of the component with a molecular weight equal to or less than 1,000)}×100

Method for Measuring the Glass Transition Temperature (Tg)

The glass transition temperature is measured in accordance with ASTM D3418-82 using a "Q2000" differential scanning calorimeter (TA Instruments).

Temperature correction in the instrument detection section is performed using the melting points of indium and zinc, and the amount of heat is corrected using the heat of fusion of indium.

Specifically, approximately 2 mg of the sample is exactly weighed out and this is introduced into an aluminum pan; an empty aluminum pan is used for reference.

The measurement is performed at a ramp rate of 10° C./min using −10° C. to 200° C. for the measurement temperature range.

For the measurement, heating is carried out from −10° C. to 200° C. at a ramp rate of 10° C./min followed by cooling from 200° C. to −10° C. at a ramp down rate of 10° C./min. This is followed by heating again from −10° C. to 200° C. at a ramp rate of 10° C./min.

The DSC curve in the temperature range from 20° C. to 100° C. in the second heating process is used.

Using the DSC curve obtained in the second heating process, the glass transition temperature (Tg) is taken to be the temperature (° C.) at the intersection between the DSC curve and the line for the midpoint for the baselines for prior to and subsequent to the appearance of the change in the specific heat.

Method for Measuring the Softening Point (Tm)

The softening point is measured using a "Flowtester CFT-500D Flow Property Evaluation Instrument" (Shimadzu Corporation), which is a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve showing the relationship between the piston stroke and the temperature can be obtained during this process. The "melting temperature by the ½ method", as described in the manual provided with the "Flowtester CFT-500D Flow Property Evaluation Instrument", is used as the softening point. The melting temperature by the ½ method is determined as follows.

First, ½ of the difference between Smax, i.e., the piston stroke at the completion of outflow, and Smin, i.e., the piston stroke at the beginning of outflow, is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the sample to compression molding for approximately 60 seconds at approximately 10 MPa in a 25° C. environment using a tablet compression molder (for example, the NT-100H, NPa System Co., Ltd.) to provide a cylindrical shape with a diameter of approximately 8 mm.

The measurement conditions with the CFT-500D are as follows.

test mode: ramp-up method
ramp rate: 4° C./min
start temperature: 40° C.
saturated temperature: 200° C.
measurement interval: 1.0° C.
piston cross section area: 1.000 $cm^2$
test load (piston load): 10.0 kgf (0.9807 MPa)
preheating time: 300 seconds
diameter of die orifice: 1.0 mm
die length: 1.0 mm Method for Measuring the Weight-Average Particle Diameter (D4) of the Toner The weight-average particle diameter (D4) of the toner is determined as follows. The measurement instrument used is a "Coulter Counter Multisizer 3" (registered trademark, Beckman Coulter, Inc.), a precision particle size distribution measurement instrument operating on the pore electrical resistance method and equipped with a 100 μm aperture tube. The measurement conditions are set and the measurement data are analyzed using the accompanying dedicated software, i.e., "Beckman Coulter Multisizer 3 Version 3.51" (Beckman Coulter, Inc.). The measurements are carried out in 25,000 channels for the number of effective measurement channels.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the "threshold value/noise level measurement button". In addition, the current is set to 1600 μA; the gain is set to 2; the electrolyte is set to ISOTON II; and a check is entered for the "post-measurement aperture tube flush".

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the approximately three-fold (mass) dilution with deionized water of "Contaminon N" (product name; a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) An "Ultrasonic Dispersion System Tetora 150" (product name; Nikkaki Bios Co., Ltd.) is prepared; this is an ultrasound disperser with an electrical output of 120 W and is equipped with two oscillators (oscillation frequency=50 kHz) disposed such that the phases are displaced by 180°. Approximately 3.3 L of deionized water is introduced into the water tank of this ultrasound disperser and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the "analysis/volumetric statistical value (arithmetic average)" screen is the weight-average particle diameter (D4).

EXAMPLES

The present invention is described in additional detail through the following examples and comparative examples; however, the present invention is in no way limited thereby. Unless specifically indicated otherwise, parts and % in the examples are on a mass basis.

Long-Chain Alkyl Monomer (W-1) Production Example 1,200 parts of a chain saturated hydrocarbon having an average number of carbons of 35 was introduced into a cylindrical glass reaction vessel, and 38.5 parts of boric acid was added at a temperature of 140° C. This was immediately followed by the injection, at a rate of 20 L per minute, of a mixed gas containing 50 volume % air and 50 volume % nitrogen and having an oxygen concentration of approximately 10 volume %, and a reaction was carried out for 3.0 hours at 200° C. After the reaction, hot water was added to the reaction solution and hydrolysis was carried out for 2 hours at 95° C. and, after standing at quiescence, a reaction product (modification product) was obtained as the upper layer. 20 parts of the obtained modification product was added to 100 parts of n-hexane and the unmodified component was dissolved and removed to obtain a long-chain alkyl monomer (W-1). The properties of the obtained long-chain alkyl monomer (W-1) are given in Table 1. The long-chain alkyl monomer (W-1) has a modification percentage of 93.6% and contains the chain saturated hydrocarbon that had not undergone the alcohol modification. Similarly, the long-chain alkyl monomer (W-2) also contains the chain saturated hydrocarbon that had not undergone alcohol modification.

TABLE 1

| Long-chain alkyl monomer No. | Long-chain alkyl component | Average number of carbons | Modification percentage (%) | Hydroxyl value (mgKOH/g) | Acid value (mgKOH/g) |
|---|---|---|---|---|---|
| W-1 | Saturated monoalcohol modification product (secondary) | 35 | 93.6 | 115 | — |
| W-2 (※) | Saturated monoalcohol modification product (primary) | 48 | 80.3 | 72 | — |

W-2 (※) in Table 1 is UNILIN 700 (Toyo Petrolite Co., Ltd.)

Polyester Resin Composition (A-1) Production Example bisphenol A ethylene oxide adduct (2.0 mol adduct) 50.0 mol parts bisphenol A propylene oxide adduct (2.3 mol adduct) 50.0 mol parts terephthalic acid 64.0 mol parts trimellitic anhydride 18.0 mol parts In addition to 90 parts of this polyester monomer, the long-chain alkyl monomer (W-1) was added so as to provide 7.5 mass % with regard to the total polyester resin composition.

The resulting mixture was introduced into a four-neck flask; a pressure-reduction apparatus, water separator, nitrogen gas introduction apparatus, temperature measurement apparatus, and stirrer were mounted; and stirring was carried out at 160° C. in a nitrogen atmosphere.

To this was added dropwise, over 4 hours from a dropping funnel, a mixture of 10 parts of vinyl polymer monomer (styrene: 10.0 mol parts, n-butyl acrylate: 90.0 mol parts) constituting the vinyl polymer segment and 2.0 mol parts of benzoyl peroxide as polymerization initiator. This was followed by reaction for 5 hours at 160° C., and the temperature was then raised to 230° C. and 0.05 mass % tetraisobutyl titanate was added and the reaction time was adjusted to achieve the desired viscosity.

The completion of the reaction was followed by removal from the vessel, cooling, and pulverization to obtain a polyester resin composition (A-1). The properties of the obtained polyester resin composition (A-1) are given in Table 3. The polyester resin composition (A-1) contains the chain saturated hydrocarbon (aliphatic hydrocarbon) present in the long-chain alkyl monomer (W-1).

Polyester Resin Compositions (A-2) to (A-14) and (A-16) to (A-17) Production Example Polyester resin compositions (A-2) to (A-14) and (A-16) to (A-17) were obtained proceeding as in the Polyester Resin Composition (A-1) Production Example, but changing to the monomer formulations given in Table 2. The properties of the obtained polyester resin compositions (A-2) to (A-14) and (A-16) to (A-17) are given in Table 3.

The following abbreviations are used in Table 2.

BPA-PO: bisphenol A propylene oxide adduct (2.0 mol adduct)

BPA-EO: bisphenol A ethylene oxide adduct (2.0 mol adduct)

TPA: terephthalic acid

TMA: trimellitic anhydride

St: styrene

BA: n-butyl acrylate

*1: The mol parts of the monomer gives the ratio when the total amount of monomer of the alcohol component (excluding the long-chain alkyl monomer) is used as 100 mol parts.

*2: The mol parts of the monomer gives the ratio when the total amount of monomer for the vinyl polymer segment is used as 100 mol parts.

*3: The PES/StAc ratio is polyester segment (excluding the long-chain alkyl monomer)/vinyl polymer segment (mass basis).

*4: The mol % refers to the ratio when the total amount of monomer for the polyester segment (excluding the long-chain alkyl monomer) is used as 100 mol parts.

Polyester Resin Composition (A-15) Production Example

| | |
|---|---|
| bisphenol A propylene oxide adduct (2.0 mol adduct) | 100.0 mol parts |
| terephthalic acid | 64.0 mol parts |
| adipic acid | 10.0 mol parts |

These starting monomers were added to a reactor fitted with a nitrogen introduction line, a water separator, a stirrer, and a thermocouple, and 1.0 parts of dibutyltin was then added as catalyst per 100 parts of the total amount of starting monomer.

The temperature in the reactor was raised to 150° C. while stirring in a nitrogen atmosphere, and a polymerization was

TABLE 2

| Polyester resin composition No. | Charged composition for polyester (PES) segment (*1) BPA-PO (mol parts) | BPA-EO (mol parts) | TPA (mol parts) | TMA (mol parts) | Acrylic acid (mol parts) | Long-chain alkyl monomer No. | Long-chain alkyl monomer mass % | Charged composition for the vinyl polymer segment (*2) St (mol parts) | BA (mol parts) | PES/StAc Ratio (*3) | St/Ac Ratio | BPA-EO amount (mol %) (*4) |
|---|---|---|---|---|---|---|---|---|---|---|---|---|
| A-1 | 50 | 50 | 64 | 18 | 0 | W-1 | 7.5 | 10 | 90 | 90/10 | 10/90 | 27 |
| A-2 | 50 | 50 | 64 | 18 | 0 | W-1 | 5.0 | 10 | 90 | 90/10 | 10/90 | 27 |
| A-3 | 50 | 50 | 64 | 18 | 0 | W-1 | 3.5 | 10 | 90 | 90/10 | 10/90 | 27 |
| A-4 | 50 | 50 | 64 | 18 | 0 | W-1 | 9.0 | 10 | 90 | 90/10 | 10/90 | 27 |
| A-5 | 50 | 50 | 64 | 18 | 0 | W-1 | 2.5 | 10 | 90 | 90/10 | 10/90 | 27 |
| A-6 | 50 | 50 | 64 | 18 | 0 | W-1 | 10.0 | 10 | 90 | 90/10 | 10/90 | 27 |
| A-7 | 50 | 50 | 64 | 18 | 0 | W-1 | 2.0 | 10 | 90 | 90/10 | 10/90 | 27 |
| A-8 | 50 | 50 | 64 | 18 | 0 | W-1 | 11.0 | 10 | 90 | 90/10 | 10/90 | 27 |
| A-9 | 9 | 91 | 64 | 18 | 0 | W-1 | 2.0 | 5 | 95 | 90/10 | 5/95 | 50 |
| A-10 | 82 | 18 | 64 | 18 | 0 | W-1 | 2.0 | 20 | 80 | 90/10 | 20/80 | 10 |
| A-11 | 0 | 100 | 64 | 16 | 0 | W-1 | 2.0 | 4 | 96 | 90/10 | 4/96 | 55 |
| A-12 | 85 | 15 | 64 | 20 | 0 | W-1 | 2.0 | 22 | 78 | 90/10 | 22/78 | 8 |
| A-13 | 0 | 100 | 64 | 14 | 0 | W-1 | 2.0 | 2 | 98 | 95/5 | 2/98 | 55 |
| A-14 | 85 | 15 | 64 | 22 | 0 | W-1 | 2.0 | 25 | 75 | 95/5 | 25/75 | 8 |
| A-16 | 50 | 50 | 75 | 10 | 0 | — | — | — | — | 100/0 | — | 27 |
| A-17 | 70 | 30 | 65 | 20 | 7 | — | — | 85 | 15 | 80/20 | 85/15 | 16 |

then run by distilling out water while heating from 150° C. to 200° C. at a ramp rate of 10° C./hour.

After reaching 200° C., the pressure in the reactor was reduced to 5 kPa or less and a polycondensation was run for 3 hours under conditions of 200° C. and 5 kPa or less.

Then, after returning to normal pressure, 15.0 mol parts of benzoic acid was added and a reaction was run for 2 hours while stirring in a nitrogen atmosphere.

| | |
|---|---|
| bisphenol A propylene oxide adduct (2.0 mol adduct) | 29.3 mol parts |
| terephthalic acid | 8.8 mol parts |
| isophthalic acid | 5.9 mol parts |
| adipic acid | 4.4 mol parts |
| trimellitic anhydride | 2.9 mol parts |

Then, after cooling to 150° C. while stirring under a nitrogen atmosphere, the aforementioned starting monomers, which were used for polymerization of the crosslinked component, were introduced.

A polymerization was then run by distilling out water while heating from 150° C. to 220° C. at a ramp rate of 10° C./hour while stirring in a nitrogen atmosphere.

After 220° C. had been reached, the pressure within the reactor was reduced to 5 kPa or less and a polycondensation was run for 3 hours under conditions of 220° C. and 5 kPa or less.

Then, after returning to normal pressure, 4.4 mol parts of trimellitic anhydride was introduced and a polycondensation was run for 3 hours while stirring under a nitrogen atmosphere.

The pressure in the reactor was reduced to 5 kPa or less; polycondensation was carried out for 3 hours while stirring; and polyester resin composition (A-15) was then produced by removal, cooling, and pulverization. The properties of the obtained polyester resin composition (A-15) are given in Table 3.

Polyester Resin Composition (A-18) Production Example

| | |
|---|---|
| bisphenol A propylene oxide adduct (2.0 mol adduct) | 100.0 mol parts |
| terephthalic acid | 38.8 mol parts |
| stearic acid | 16.7 mol parts |

A mixture of 100 parts of this monomer was introduced into a four-neck flask; a pressure reduction apparatus, water separator, nitrogen gas introduction apparatus, temperature measurement apparatus, and stirrer were installed; and stirring was carried out at 160° C. under a nitrogen atmosphere. The temperature was raised to 230° C.; 0.05 mass % tetraisobutyl titanate was added; and the reaction time was adjusted so as to give the desired viscosity.

The completion of the reaction was followed by removal from the vessel, cooling, and pulverization to obtain the polyester resin composition (A-18). The properties of the obtained polyester resin composition (A-18) are given in Table 3.

TABLE 3

| Polyester resin composition No. | Glass transition temperature Tg (° C.) | Softening point Tm (° C.) | Acid value (mgKOH/g) | Peak temperature of maximum endothermic peak (° C.) | Endothermic quantity (ΔH) (J/g) |
|---|---|---|---|---|---|
| A-1 | 59.4 | 131.5 | 18.2 | 75.3 | 1.23 |
| A-2 | 60.9 | 130.2 | 23.6 | 75.9 | 0.66 |
| A-3 | 61.0 | 130.6 | 23.7 | 76.1 | 0.52 |
| A-4 | 59.6 | 131.5 | 24.1 | 75.8 | 1.68 |
| A-5 | 61.2 | 131.2 | 23.1 | 75.2 | 0.21 |
| A-6 | 59.1 | 130.6 | 16.3 | 74.6 | 1.87 |
| A-7 | 61.6 | 132.6 | 31.2 | 75.1 | 0.06 |
| A-8 | 58.7 | 130.1 | 14.2 | 75.6 | 2.06 |
| A-9 | 61.2 | 125.6 | 35.1 | 75.9 | 0.05 |
| A-10 | 60.9 | 135.8 | 34.7 | 75.6 | 0.04 |
| A-11 | 60.6 | 126.1 | 34.8 | 75.9 | 0.06 |
| A-12 | 61.2 | 134.3 | 33.6 | 75.1 | 0.04 |
| A-13 | 61.1 | 125.1 | 35.1 | 75.6 | 0.06 |
| A-14 | 60.5 | 135.1 | 33.8 | 75.3 | 0.04 |
| A-15 | 68.6 | 138.5 | 17.6 | — | 0 |
| A-16 | 61.2 | 141.2 | 22.6 | — | 0 |
| A-17 | 60.3 | 133.9 | 24.6 | — | 0 |
| A-18 | 45.1 | 95.1 | 6.9 | — | 0 |

Polyester Resin Composition (B-1) Production Example

The starting monomers indicated in Table 4 were introduced in the blend amounts (mol parts) indicated in Table 4 into a reactor fitted with a nitrogen introduction line, a water separator, a stirrer, and a thermocouple, and 1.0 parts of dibutyltin was then added as catalyst per 100 parts of the total amount of starting monomer. At this time, as a long-chain alkyl monomer, W-2 (UNILIN 700 (Toyo Petrolite Co., Ltd.) was used.

The temperature in the reactor was raised to 150° C. while stirring under a nitrogen atmosphere, and a polymerization was then run by distilling out water while heating from 150° C. to 200° C. at a ramp rate of 10° C./hour.

After reaching 200° C., the pressure in the reactor was reduced to 5 kPa or less and a polycondensation was run for 3 hours under conditions of 200° C. and 5 kPa or less.

The completion of the reaction was followed by removal from the vessel, cooling, and pulverization to obtain the polyester resin composition (B-1). The properties of the obtained polyester resin composition (B-1) are given in Table 5. This polyester resin composition (B-1) contains the chain saturated hydrocarbon (aliphatic hydrocarbon) present in the long-chain alkyl monomer (W-2).

Polyester Resin Compositions (B-2) to (B-3) Production Example

The polyester resin compositions (B-2) to (B-3) were obtained proceeding as in the Polyester Resin Composition (B-1) Production Example, but changing to the monomer formulations indicated in Table 4. The properties of the obtained polyester resin compositions (B-2) to (B-3) are given in Table 5.

TABLE 4

| Polyester resin composition No. | Charged composition for the polyester resin (*1) BPA-PO (mol parts) | BPA-EO (mol parts) | EG (mol parts) | TPA (mol parts) | IPA (mol parts) | Long-chain alkyl monomer No. | Long-chain alkyl monomer mass % | Amount of EG (mol %) (*2) |
|---|---|---|---|---|---|---|---|---|
| B-1 | 41 | 37 | 22 | 85 | 1 | W-2 | 8.0 | 22 |
| B-2 | 41 | 37 | 22 | 85 | 1 | — | 0.0 | 22 |
| B-3 | 60 | 40 | 0 | 77 | 0 | — | 0.0 | 0 |

The following abbreviations are used in Table 4.

BPA-PO: bisphenol A propylene oxide adduct (2.0 mol adduct)

BPA-EO: bisphenol A ethylene oxide adduct (2.0 mol adduct)

EG: ethylene glycol

TPA: terephthalic acid

IPA: isophthalic acid

*1: The mol parts of the monomer gives the ratio when the total amount of monomer of the alcohol component (excluding the long-chain alkyl monomer) is used as 100 mol parts.

*2: The mol % gives the ratio when the total alcohol monomer unit for the polyester resin (excluding the long-chain alkyl monomer) is used as 100 mol parts.

TABLE 5

| Polyester resin composition No. | Glass transition temperature Tg (° C.) | Softening point Tm (° C.) | Acid value (mgKOH/g) | Peak temperature of maximum endothermic peak (° C.) | Endothermic quantity (ΔH) (J/g) | Proportion for molecular weights equal to or less than 1,000 (mass %) |
|---|---|---|---|---|---|---|
| B-1 | 58.3 | 95.6 | 7.5 | 105.3 | 3.22 | 8 |
| B-2 | 59.1 | 106.4 | 7.2 | — | — | 10 |
| B-3 | 56.2 | 121.3 | 9.6 | — | — | 12 |

Toner (T-1) Production Example

| | |
|---|---|
| polyester resin composition (A-1) | 50.0 parts |
| polyester resin composition (B-1) | 50.0 parts |
| magnetic iron oxide particles (octahedral shape) | 60.0 parts |

(number-average particle diameter=0.13 μm, coercive force Hc=11.5 kA/m, magnetization $\sigma_s$=88 $Am^2/kg$, residual magnetization $\sigma_r$=14 $Am^2/kg$ [the magnetic properties are values for the application of an external magnetic field of 10 kOe])

| | |
|---|---|
| release agent (Fischer-Tropsch wax) (C105, melting point = 105° C., Sasol Limited) | 2.0 parts |
| charge control agent (T-77, Hodogaya Chemical Co., Ltd.) | 2.0 parts |

These materials were premixed with a Henschel mixer, followed by melt-kneading with a twin-screw kneader-extruder (Model PCM-30, Ikegai Ironworks Corporation).

The obtained melt-kneaded material was cooled and coarsely pulverized with a hammer mill and was then pulverized with a mechanical pulverizer (T-250, Turbo Kogyo Co., Ltd.), and the resulting finely pulverized powder was classified using a Coanda effect-based multi-grade classifier to obtain a negative-charging toner particle having a weight-average particle diameter (D4) of 7.0 μm. 1.0 parts of a hydrophobic silica fine particle 1 [BET specific surface area of 150 $m^2/g$, after hydrophobic treatment with 30 parts hexamethyldisilazane (HMDS) and 10 parts dimethylsilicone oil per 100 parts of the silica fine particles] and 0.6 parts of strontium titanate fine particles (median diameter: 1.0 μm) were externally mixed using a Henschel mixer (Model FM-75, Nippon Coke & Engineering. Co., Ltd.) with 100 parts of the toner particle, followed by sieving on a mesh with an aperture of 150 μm to obtain a toner (T-1). The properties of the obtained toner (T-1) are given in Table 7. Toner (T-1) has relative minimum values of equal to or less than $-1.00\times10^7$ in its dE'/dT curve.

Toners (T-2) to (T-23) and (T-28) Production Example

Toners (T-2) to (T-23) and (T-28) were produced proceeding as in the Toner (T-1) Production Example, but using the formulations indicated in Table 6. The properties of the resulting toners (T-2) to (T-23) and (T-28) are given in Table 7. Toners (T-2) to (T-23) and (T-28) have a relative minimum value of equal to or less than $-1.00\times10^7$ in their dE'/dT curves.

Toners (T-24) to (T-25) Production Example

Toners (T-24) to (T-25) were produced proceeding as in the Toner (T-1) Production Example, but using the formulations indicated in Table 6 and changing the 60.0 parts of magnetic iron oxide particles to 4.0 parts of carbon black. The properties of the resulting toners (T-24) to (T-25) are given in Table 7. Toners (T-24) to (T-25) have relative minimum values of equal to or less than $-1.00\times10^7$ in their dE'/dT curves.

Toner (T-26) Production Example

Toner (T-26) was produced proceeding as in the Toner (T-1) Production Example, but using polyester resin composition (A-16) in place of polyester resin composition (A-1), using polyester resin composition (B-3) in place of polyester resin composition (B-1), and adding 5.0 parts of behenyl behenate (melting point: 71° C.). The properties of the resulting toner (T-26) are given in Table 7. Toner (T-26) has relative minimum values of equal to or less than $-1.00\times10^7$ in its dE'/dT curve.

Toner (T-27) Production Example

Toner (T-27) was produced proceeding as in the Toner (T-1) Production Example, but using polyester resin composition (A-17) in place of polyester resin composition (A-1), using polyester resin composition (B-3) in place of polyester resin composition (B-1), and adding 3.0 parts of a crystalline polyester (provided by the polymerization of 1,10-decanediol as the alcohol monomer and 1,6-hexanedioic acid as the carboxylic acid monomer, melting point: 71° C., molecular weight (Mp): 17,000). The properties of the resulting toner (T-27) are given in Table 7. Toner (T-27) has relative minimum values of equal to or less than $-1.00\times10^7$ in its dE'/dT curve.

Toner (T-29) Production Example (1) Preparation of a resin particle dispersion

| | |
|---|---|
| styrene | 75.0 parts |
| n-butyl acrylate | 25.0 parts |
| acrylic acid | 2.0 parts |
| crystalline polyester | 7.0 parts |

(provided by the polymerization of 1,10-decanediol as the alcohol monomer and 1,6-hexanedioic acid as the carboxylic acid monomer, melting point: 71° C., molecular weight (Mp): 17,000)

These materials were mixed and dissolved to prepare a solution.

An aqueous medium was prepared in which 1.5 parts of a nonionic surfactant (Nonipol 400, Sanyo Chemical Industries, Ltd.) and 2.2 parts of an anionic surfactant (Neogen SC, DKS Co. Ltd.) were mixed and dissolved in 120 parts of deionized water. This aqueous medium and the aforementioned solution were introduced into a flask and the solution was dispersed and emulsified, and, while gently mixing for 10 minutes, 10 parts of deionized water in which 1.0 parts of ammonium persulfate had been dissolved was introduced thereinto. After nitrogen substitution had been carried out and while stirring the interior of the flask, the contents were heated to a temperature of 70° C. on an oil bath and an emulsion polymerization was continued in this state for 5 hours to prepare a resin particle dispersion in which resin particles having a number-average particle diameter of 0.29 μm were dispersed.

(2) Preparation of a Colorant Particle Dispersion

| | |
|---|---|
| carbon black | 20.0 parts |
| anionic surfactant (Neogen SC, DKS Co. Ltd. ) | 2.0 parts |
| deionized water | 78.0 parts |

These materials were mixed and dispersion was carried out using a sand grinder mill. When the particle size distribution of this colorant particle dispersion was measured using a particle size distribution analyzer (LA-700, Horiba, Ltd.), the average particle diameter of the contained colorant particles was 0.2 μm and coarse particles larger than 1.0 μm were not observed.

(3) Preparation of a Release Agent Particle Dispersion

| | |
|---|---|
| ester wax (dibehenyl behenate, melting point = 65° C.) | 50.0 parts |
| anionic surfactant (Neogen SC, DKS Co. Ltd.) | 5.0 parts |
| deionized water | 200.0 parts |

These materials were heated to 95° C. and dispersion was carried out using an homogenizer (Ultra-Turrax T50, IKA), and this was followed by dispersion processing using a pressure ejection homogenizer to prepare a wax dispersion in which wax particles having a number-average particle diameter of 0.5 μm were dispersed.

(4) Preparation of a Charge Control Agent Particle Dispersion

| | |
|---|---|
| metal compound of dialkylsalicylic acid (negative chargeability control agent, BONTRON E-84, Orient Chemical Industries Co., Ltd.) | 20.0 parts |
| anionic surfactant (Neogen SC, DKS Co. Ltd.) | 2.0 parts |
| deionized water | 78.0 parts |

These materials were mixed and were dispersed using a sand grinder mill. When the numerical particle size distribution of this charge control particle dispersion was measured using a particle size distribution analyzer (LA-700, Horiba, Ltd.), the number-average particle diameter of the contained charge control agent particles was 0.2 μm and coarse particles larger than 1.0 μm were not observed.

(5) Mixture Preparation

| | |
|---|---|
| resin particle dispersion | 360.0 parts |
| colorant particle dispersion | 40.0 parts |
| release agent particle dispersion | 70.0 parts |

These materials were introduced into a 1-L separable flask equipped with a stirrer, condenser, and thermometer and were stirred. The mixture was adjusted to pH 5.2 using 1 N potassium hydroxide.

(6) Formation of Aggregate Particles 150 parts of a 10% aqueous sodium chloride solution was added dropwise as an aggregating agent to the resulting mixture, and heating to a temperature of 57° C. was carried out while stirring the interior of the flask placed on a heating oil bath. When this temperature was reached, 3 parts of the resin particle dispersion and 10 parts of the charge control agent particle dispersion were added. After holding for 2 hours at 52° C., it was confirmed by observation with an optical microscope that aggregate particles having a number-average particle diameter of approximately 7.1 μm had been formed.

(7) Melt Adhesion Step

This was followed by the addition of 3 parts of an anionic surfactant (Neogen SC, DKS Co. Ltd.) and then heating to a temperature of 95° C. in a stainless steel flask and holding for 4.5 hours while continuing to stir using a magnetic seal. After cooling, the reaction product was filtered off and was thoroughly washed with deionized water; fluidized bed drying at 45° C. was then performed; and shape adjustment was carried out by dispersion in the gas phase in a spray dryer at least 200° C. and not more than 300° C. to obtain a toner particle.

1.0 parts of the hydrophobic silica fine particle 1 and 0.6 parts of strontium titanate fine particles (median diameter: 1.0 μm) were externally mixed using a Henschel mixer with 100 parts of the toner particle, followed by sieving on a mesh with an aperture of 150 μm to obtain a toner (T-29). The properties of the obtained toner (T-29) are given in Table 7. Toner (T-29) has relative minimum values of equal to or less than $-1.00\times10^7$ in its dE'/dT curve.

Toner (T-30) Production Example 850 parts of a 0.1 mol/L aqueous solution of $Na_3PO_4$ was added to a vessel equipped with a Clearmix high-speed stirrer (M Technique Co., Ltd.), and heating was carried out to 60° C. while stirring at a rotation peripheral velocity of 33 m/sec. 68 parts of a 1.0 mol/L aqueous solution of $CaCl_2$ was added to this to prepare an aqueous medium containing the microfine sparingly water-soluble dispersing agent $Ca_3(PO_4)_2$. A solution was prepared by mixing and dissolving the following materials using a propeller stirrer. A rotation rate for the stirrer of 100 r/min was used during the mixing of these materials.

| | |
|---|---|
| styrene | 75.0 parts |
| n-butyl acrylate | 25.0 parts |
| carbon black | 4.0 parts |
| iron complex of monoazo dye (T-77, Hodogaya Chemical Co., Ltd.) | 1.0 parts |
| dibehenyl behenate (melting point: 71° C.) | 5.0 parts |

The mixture was heated to a temperature of 60° C. followed by stirring with a TK Homomixer (Primix Corporation (formerly Tokushu Kika Kogyo Co., Ltd.)) with the stirring rate of the stirrer set to 9,000 r/min, to dissolve and disperse the solids.

Into this was introduced 10.0 parts of the polymerization initiator 2,2'-azobis(2,4-dimethylvaleronitrile) with dissolution in the mixture to prepare a polymerizable monomer composition. This polymerizable monomer composition was introduced into the aforementioned aqueous medium and, after heating to a temperature of 60° C., granulation was performed for 15 minutes while having the Clearmix rotate at a rotation peripheral velocity of 33 m/sec.

This was followed by transfer to a propeller stirrer and, while stirring at 100 rotations per minute, a reaction was run for 5 hours at a temperature of 70° C. followed by heating to a temperature of 85° C. and an additional reaction for 4 hours to produce a toner particle.

After the completion of the polymerization reaction, the suspension was heated to 100° C. and held for 2 hours and the residual monomer was removed by heating under reduced pressure. After cooling, the inorganic fine particles were dissolved by adding hydrochloric acid and lowering the pH to 2.0 or below. Water washing was carried out multiple times; drying was then performed for 72 hours at 40° C. using a dryer; and classification was subsequently carried out using a Coanda effect-based multi-grade classifier to obtain a toner particle.

1.0 parts of hydrophobic silica fine particle 1 and 0.6 parts of strontium titanate fine particles (median diameter: 1.0 μm) were externally mixed using a Henschel mixer with 100 parts of the toner particle, followed by sieving on a mesh with an aperture of 150 μm to obtain a toner (T-30). The properties of the obtained toner (T-30) are given in Table 7. Toner (T-30) has relative minimum values of equal to or less than $-1.00\times10^7$ in its dE'/dT curve.

TABLE 6

| Toner No. | T-1 | T-2 | T-3 | T-4 | T-5 | T-6 | T-7 | T-8 |
|---|---|---|---|---|---|---|---|---|
| Resin composition A | A-1 | A-1 | A-1 | A-2 | A-3 | A-4 | A-5 | A-6 |
| Resin composition B | B-1 | B-1 | B-1 | B-1 | B-1 | B-1 | B-1 | B-1 |
| Resin composition A/resin composition B (mass ratio) | 50/50 | 70/30 | 30/70 | 50/50 | 50/50 | 50/50 | 50/50 | 50/50 |
| Magnetic body per 100 parts of the binder resin (mass parts) | 60 | 60 | 60 | 60 | 60 | 60 | 60 | 60 |

| Toner No. | T-9 | T-10 | T-11 | T-12 | T-13 | T-14 |
|---|---|---|---|---|---|---|
| Resin composition A | A-7 | A-8 | A-7 | A-7 | A-7 | A-7 |
| Resin composition B | B-1 | B-1 | B-2 | B-3 | B-3 | B-3 |
| Resin composition A/resin composition B (mass ratio) | 50/50 | 50/50 | 50/50 | 50/50 | 50/50 | 50/50 |
| Magnetic body per 100 parts of the binder resin (mass parts) | 60 | 60 | 60 | 60 | 40 | 70 |

| トナNo. | T-15 | T-16 | T-17 | T-18 | T-19 | T-20 |
|---|---|---|---|---|---|---|
| Resin composition A | A-7 | A-7 | A-9 | A-10 | A-11 | A-12 |
| Resin composition B | B-3 | B-3 | B-3 | B-3 | B-3 | B-3 |
| Resin composition A/resin composition B (mass ratio) | 50/50 | 50/50 | 50/50 | 50/50 | 50/50 | 50/50 |
| Magnetic body per 100 parts of the binder resin (mass parts) | 30 | 80 | 80 | 80 | 80 | 80 |

| Toner No. | T-21 | T-22 | T-23 | T-24 | T-25 | T-28 |
|---|---|---|---|---|---|---|
| Resin composition A | A-13 | A-14 | A-15 | A-7 | A-15 | A-18 |
| Resin composition B | B-3 | B-3 | B-3 | B-3 | B-3 | B-3 |
| Resin composition A/resin composition B (mass ratio) | 50/50 | 50/50 | 50/50 | 50/50 | 50/50 | 50/50 |
| Magnetic body per 100 parts of the binder resin (mass parts) | 80 | 80 | 80 | 0 | 0 | 80 |

TABLE 7

| Toner No. | D4 (μm) | Powder dynamic viscoelastic measurements: Relative minimum value of (dE'/dT) | E'(50) | E'(50)/E'(120) | E'(120) | α mass % | β mass % | (α − β) mass % |
|---|---|---|---|---|---|---|---|---|
| T-1 | 7.1 | $-1.40 \times 10^8$ | $5.14 \times 10^9$ | 2.07 | $1.15 \times 10^8$ | 27.4 | 7.1 | 20.3 |
| T-2 | 7.2 | $-1.33 \times 10^8$ | $5.32 \times 10^9$ | 1.86 | $1.58 \times 10^8$ | 28.1 | 8.9 | 19.2 |
| T-3 | 7.4 | $-1.45 \times 10^8$ | $5.03 \times 10^9$ | 2.21 | $1.12 \times 10^7$ | 27.6 | 8.8 | 18.8 |
| T-4 | 7.3 | $-1.21 \times 10^8$ | $5.23 \times 10^9$ | 2.01 | $1.08 \times 10^8$ | 25.3 | 6.8 | 18.5 |
| T-5 | 7.2 | $-1.20 \times 10^8$ | $5.33 \times 10^9$ | 1.97 | $9.95 \times 10^7$ | 24.6 | 6.7 | 17.9 |
| T-6 | 7.3 | $-1.36 \times 10^8$ | $4.98 \times 10^9$ | 2.10 | $1.58 \times 10^8$ | 26.8 | 7.1 | 19.7 |
| T-7 | 7.2 | $-1.18 \times 10^8$ | $5.35 \times 10^9$ | 1.95 | $9.60 \times 10^7$ | 24.1 | 6.8 | 17.3 |
| T-8 | 7.1 | $-1.43 \times 10^8$ | $4.61 \times 10^9$ | 2.35 | $2.36 \times 10^8$ | 27.6 | 7.3 | 20.3 |
| T-9 | 7.3 | $-1.15 \times 10^8$ | $5.43 \times 10^9$ | 1.84 | $9.23 \times 10^7$ | 23.6 | 6.4 | 17.2 |
| T-10 | 7.2 | $-1.52 \times 10^8$ | $3.89 \times 10^9$ | 2.14 | $2.43 \times 10^8$ | 27.7 | 7.6 | 20.1 |
| T-11 | 7.1 | $-1.12 \times 10^8$ | $5.41 \times 10^9$ | 1.76 | $8.50 \times 10^7$ | 25.1 | 6.9 | 18.2 |
| T-12 | 7.0 | $-1.18 \times 10^8$ | $4.72 \times 10^9$ | 2.19 | $1.46 \times 10^8$ | 25.2 | 6.7 | 18.5 |
| T-13 | 7.1 | $-1.26 \times 10^8$ | $3.43 \times 10^9$ | 2.31 | $1.22 \times 10^8$ | 26.8 | 7.5 | 19.3 |
| T-14 | 7.3 | $-1.11 \times 10^8$ | $5.16 \times 10^9$ | 1.92 | $1.52 \times 10^8$ | 24.1 | 5.6 | 18.5 |
| T-15 | 7.2 | $-1.29 \times 10^8$ | $2.37 \times 10^9$ | 2.42 | $1.16 \times 10^8$ | 26.3 | 7.7 | 18.6 |
| T-16 | 7.1 | $-1.08 \times 10^8$ | $6.21 \times 10^9$ | 1.83 | $1.68 \times 10^8$ | 24.5 | 5.4 | 19.1 |
| T-17 | 7.2 | $-1.11 \times 10^8$ | $7.54 \times 10^9$ | 2.32 | $1.27 \times 10^8$ | 29.8 | 5.2 | 24.6 |
| T-18 | 7.4 | $-1.12 \times 10^8$ | $4.21 \times 10^9$ | 2.41 | $1.14 \times 10^8$ | 19.8 | 4.7 | 15.1 |
| T-19 | 7.1 | $-1.14 \times 10^8$ | $8.42 \times 10^9$ | 2.48 | $7.92 \times 10^7$ | 29.9 | 4.8 | 25.1 |
| T-20 | 7.2 | $-1.06 \times 10^8$ | $2.11 \times 10^9$ | 2.56 | $9.62 \times 10^7$ | 21.2 | 8.8 | 12.4 |
| T-21 | 7.3 | $-1.12 \times 10^8$ | $8.98 \times 10^9$ | 2.66 | $7.93 \times 10^7$ | 30.2 | 4.8 | 25.4 |
| T-22 | 7.2 | $-1.03 \times 10^8$ | $1.16 \times 10^9$ | 2.81 | $7.24 \times 10^7$ | 17.7 | 3.2 | 14.5 |
| T-23 | 7.5 | $-1.24 \times 10^8$ | $1.22 \times 10^9$ | 2.28 | $7.64 \times 10^7$ | 16.2 | 5.4 | 10.8 |
| T-24 | 7.2 | $-1.35 \times 10^8$ | $1.54 \times 10^9$ | 2.56 | $7.52 \times 10^7$ | 27.1 | 7.9 | 19.2 |
| T-25 | 7.3 | $-1.07 \times 10^8$ | $1.13 \times 10^9$ | 2.36 | $7.58 \times 10^7$ | 17.4 | 4.9 | 12.5 |
| T-26 | 7.2 | $-1.18 \times 10^8$ | $4.03 \times 10^9$ | 1.24 | $5.22 \times 10^7$ | 17.3 | 7.2 | 10.1 |
| T-27 | 7.1 | $-1.03 \times 10^8$ | $4.65 \times 10^8$ | 1.71 | $7.22 \times 10^7$ | 13.8 | 4.2 | 9.6 |
| T-28 | 7.4 | $-3.25 \times 10^7$ | $3.96 \times 10^9$ | 2.11 | $4.74 \times 10^7$ | 18.7 | 8.1 | 10.6 |
| T-29 | 6.9 | $-1.14 \times 10^8$ | $5.73 \times 10^9$ | 3.08 | $7.15 \times 10^7$ | 9.7 | 2.5 | 7.2 |
| T-30 | 7.1 | $-8.22 \times 10^7$ | $9.40 \times 10^8$ | 1.51 | $5.37 \times 10^7$ | 17.3 | 6.1 | 11.2 |

Example 1

Toner (T-1) was evaluated as follows. The results of the evaluations are given in Table 8.

Unless specifically indicated otherwise, PB PAPER (Canon Marketing Japan Inc., areal weight=66 g/cm$^2$, letter) was used as the evaluation paper.

The machine used for the evaluations was an HP LaserJet Enterprise M606dn that had been modified to have a process speed of 500 mm/sec.

Evaluation 1: Dot Reproducibility

The evaluation was performed using the modified machine described above. The toner in the cartridge was emptied out and the cartridge was then filled with 700 g of toner (T-1).

Operating in a high-temperature, high-humidity environment (temperature=32.5° C., humidity=85% RH) and using 2 prints/1 job of a horizontal line pattern having a print percentage of 1.5%, a test was run in which 20,000 prints were output in a mode in which the machine was set to temporarily stop between jobs and then start the next job. For the 20,001st print, a check image having a 1 mm×1 mm solid black patch image was output. The obtained image was inspected with a VK-8500 microscope (Keyence Corporation), and, using the 1 mm×1 mm solid black patch as the center, the number of occurrences of toner scattering in a 3 mm×3 mm region was counted. The same evaluation was subsequently performed on the 20,002nd print using rough paper (Xerox 4025, 75 g/m$^2$, letter). C and above were regarded as excellent for the present invention.

A: Toner scattering is not produced.

B: Toner scattering occurs at least 1 time and not more than 10 times.

C: Toner scattering occurs at least 11 times and not more than 20 times.

D: Toner scattering occurs at least 21 times.

Evaluation 2: Halftone Image Graininess

The evaluation was performed using the modified machine described above. The toner in the cartridge was emptied out and the cartridge was then filled with 700 g of toner (T-1).

For the recording medium, the evaluation was performed using a Vitality (Xerox Corporation, areal weight=75 g/cm$^2$, letter) recording medium for which Sa (arithmetic mean height), in measurement of the surface roughness as described below, was at least 3.00 μm.

The evaluation was performed in a high-temperature, high-humidity environment (temperature=32.5° C., humidity=85% RH) for the evaluation environment, and, using 2 prints/1 job of a horizontal line pattern having a print percentage of 1.5%, a test was run in which 20,000 prints were output in a mode in which the machine was set to temporarily stop between jobs and then start the next job.

A halftone image was formed over the entire side of the recording medium for the 20,001st print.

The set temperature at the fixing unit was varied depending on the toner being evaluated. Thus, a temperature at which the percentage reduction in the image density for the particular toner in the following evaluation 4 (percentage reduction in density due to rubbing) was 10% was obtained, and a temperature was set to 10° C. higher than the temperature obtained.

The presence/absence of image density non-uniformity in the halftone image was judged visually.

After this, the same evaluation was carried out on the 20,002th print, using, as a rough paper (Xerox 4025, 75 g/m$^2$, letter), a recording medium for which Sa (arithmetic mean height) was at least 4.00 μm in measurement of the surface roughness (instrument: SJ-201 Surface Roughness Measurement Instrument, Mitutoyo Corporation). C and above were regarded as excellent for the present invention.

A: Shading non-uniformity is not produced.

B: A very slight shading non-uniformity is produced.

C: Shading non-uniformity is produced, but is not very conspicuous.

D: Shading non-uniformity is produced and is conspicuous.

Evaluation 3: Image Density After Durability Testing

The evaluation was performed using the modified machine described above. The toner in the cartridge was emptied out and the cartridge was then filled with 700 g of toner (T-1).

A test was run in which 25,000 prints were output, using 2 prints/1 job of a horizontal line pattern having a print percentage of 1.5%, in a mode in which the machine was set to temporarily stop between jobs and then start the next job. The evaluation was performed in a high-temperature, high-humidity environment (temperature=32.5° C., humidity=85% RH). PB PAPER (Canon Marketing Japan Inc., areal weight=66 g/cm$^2$, letter) was used for the evaluation paper.

A check image was output having a total of nine 5 mm×5 mm solid black patch images, at 3 locations, i.e., left, right, and center, with a 5 mm leading edge margin and 5 mm right and left margins, and these at 3 locations on a 30-mm interval in the length direction.

The image density was measured at the nine solid black patch image regions of the check image and the average value was determined. The image density was measured with a MacBeth densitometer (GretagMacbeth GmbH), which is a reflection densitometer, using an SPI filter, and the evaluation was made using the following criteria. For the present invention, C or above is regarded as an acceptable level.

A: The image density is at least 1.40.

B: The image density is at least 1.30 and less than 1.40.

C: The image density is at least 1.20 and less than 1.30.

D: The image density is less than 1.20.

Evaluation 4: Low-Temperature Fixability 1—Percentage Reduction in Image Density Due to Rubbing The evaluation of the percentage reduction in image density due to rubbing used an external fixing unit provided by moving the fixing unit to the outside of the previously described machine used for the evaluations, making the temperature at the fixing unit freely settable, and modifying the fixing unit to provide a process speed of 500 mm/sec.

Using this apparatus, an unfixed image having a toner laid-on level per unit area set to 0.5 mg/cm$^2$ was passed through this fixing unit set to a temperature of 150° C. and operating in a low-temperature, low-humidity environment (temperature=15° C., humidity=10% RH). "Plover Bond" paper (105 g/m$^2$, Fox River Paper Company, LLC) was used for the recording medium. The resulting fixed image was rubbed with lens-cleaning paper under a load of 4.9 kPa (50 g/cm$^2$), and the percentage reduction (%) in the image density pre-versus-post-rubbing was evaluated. For the present invention, B or better is regarded as an acceptable level.

A: The percentage reduction in the image density is less than 10.0%.

B: The percentage reduction in the image density is at least 10.0% and less than 15.0%.

C: The percentage reduction in the image density is at least 15.0%.

Evaluation 5: Low-Temperature Fixability 2—Fixation Speckling

For the fixation speckling, an external fixing unit was used as provided by moving the fixing unit to the outside of the previously described machine used for the evaluations, making the temperature at the fixing unit freely settable, and modifying the fixing unit to provide a process speed of 500 mm/sec.

Using this apparatus, an unfixed, full-side solid image having a toner laid-on level per unit area set to 1.0 mg/cm$^2$ was passed through this fixing unit set to a temperature of 150° C. and operating in a low-temperature, low-humidity environment (temperature=15° C., humidity=10% RH). PB PAPER (Canon Marketing Japan Inc., areal weight=66 g/cm$^2$, letter) was used for the recording medium.

The obtained image was visually inspected; the number of locations was counted where toner fixation was inadequate and toner speckling occurred; and fixation speckling was evaluated using the following criteria. For the present invention, C or above is regarded as an acceptable level.

A: The speckling count is less than 4.

B: The speckling count is at least 4 and less than 8.

C: The speckling count is at least 8 and less than 11.

D: The speckling count is at least 11.

Evaluation 6: Storability under Severe Conditions

The toner in the cartridge was emptied out followed by filling with 700 g of toner (T-1). The toner was first brought into a consolidated fill condition by tapping 300 times with the drive side down.

Then, rigorous evaluation of storability was performed under severe conditions by holding the cartridge, with the drive side down, for 90 days in a severe environment (temperature=40° C., humidity=95% RH).

The cartridge was subsequently removed, and an image output test was run using the modified machine described above in a high-temperature, high-humidity environment (temperature=32.5° C., humidity=85% RH) and the storability under severe conditions was evaluated.

For the image output test, a test was first run in which 20,000 prints were output, using 2 prints/1 job of a horizontal line pattern having a print percentage of 2.0%, in a mode in which the machine was set to temporarily stop between jobs and then start the next job. This was followed by the output of a check image in the same environment.

For the check image, a 200 mm×280 mm halftone image (dot print percentage=23%) was output and the presence/absence of the production of vertical streaks in the check image was visually inspected and evaluated based on the following criteria. For the present invention, C or above is regarded as an acceptable level.

A: No streaks are produced.

B: At least 1 but not more than 5 streaks of less than 1 mm are produced, and a streak of 1 mm or larger is not produced.

C: 6 or more streaks of less than 1 mm are produced, and a streak of 1 mm or larger is not produced.

D: A streak of 1 mm or larger is produced.

Examples 2 to 23 and Comparative Examples 1 to 3

The same evaluations as in Example 1 were carried out, but changing toner (T-1) to the toner indicated in Table 8. The results are given in Table 8.

Examples 24 and 25 and Comparative Examples 4 and 5

The same evaluations as in Example 1 were carried out, but changing toner (T-1) to the toner indicated in Table 8 and using, for the machine used for the evaluations, an HP LaserJet Enterprise M553X that had been modified to a process speed of 500 mm/sec. The results are given in Table 8.

TABLE 8

| Example No. | Toner No. | Evaluation 1 Dot reproducibility: Plain paper | Evaluation 1 Dot reproducibility: Rough paper | Evaluation 2 Graininess: Plain paper | Evaluation 2 Graininess: Rough paper | Evaluation 3 Image density after durability testing | Evaluation 4 percentage reduction in image density due to rubbing (%) | Evaluation 5 speckling dots | Evaluation 6 Storability under severe conditions |
|---|---|---|---|---|---|---|---|---|---|
| 1 | T-1 | A (0) | A (0) | A | A | A(1.45) | A(5.3%) | A(0) | A |
| 2 | T-2 | A (0) | A (0) | A | A | A(1.46) | A(8.6%) | A(2) | A |
| 3 | T-3 | A (0) | A (0) | A | A | B(1.37) | A(4.6%) | A(0) | A |
| 4 | T-4 | A (0) | A (0) | A | A | A(1.43) | A(6.3%) | A(0) | A |
| 5 | T-5 | A (0) | A (0) | A | A | A(1.44) | A(6.9%) | A(1) | A |
| 6 | T-6 | A (0) | A (0) | A | A | A(1.40) | A(5.6%) | A(0) | A |
| 7 | T-7 | A (0) | A (0) | A | B | A(1.46) | A(7.3%) | A(2) | A |
| 8 | T-8 | A (0) | A (0) | A | A | B(1.39) | A(4.7%) | A(0) | A |
| 9 | T-9 | A (0) | B (2) | A | B | A(1.44) | A(7.8%) | A(2) | A |
| 10 | T-10 | A (0) | A (0) | A | A | B(1.32) | A(4.5%) | A(0) | B |
| 11 | T-11 | A (0) | B (4) | A | B | A(1.42) | A(8.3%) | B(4) | A |
| 12 | T-12 | A (0) | B (5) | B | B | B(1.38) | A(6.6%) | A(2) | A |
| 13 | T-13 | B (2) | B (7) | B | B | B(1.34) | A(6.4%) | A(1) | A |
| 14 | T-14 | A (0) | B (6) | B | B | B(1.39) | A(9.8%) | B(5) | A |
| 15 | T-15 | B (4) | B (9) | B | B | B(1.32) | A(5.9%) | A(1) | B |
| 16 | T-16 | A (0) | B (8) | B | B | B(1.39) | B(10.4%) | B(6) | A |
| 17 | T-17 | B (4) | B (8) | B | B | B(1.35) | B(12.3%) | B(5) | A |
| 18 | T-18 | B (2) | B (8) | B | B | B(1.34) | B(10.1%) | B(4) | A |
| 19 | T-19 | B (6) | B (9) | B | B | B(1.32) | B(10.5%) | B(4) | B |
| 20 | T-20 | B (4) | B (9) | B | C | B(1.38) | B(10.3%) | B(5) | A |
| 21 | T-21 | B (7) | B (10) | B | B | B(1.31) | B(10.8%) | B(5) | C |
| 22 | T-22 | B (7) | C (11) | B | C | B(1.35) | A(6.9%) | B(6) | A |
| 23 | T-23 | B (3) | B (8) | B | B | B(1.39) | B(10.4%) | B(6) | B |
| 24 | T-24 | B (3) | B (7) | B | B | B(1.31) | A(5.1%) | A(1) | B |
| 25 | T-25 | B (5) | B (8) | B | B | B(1.33) | A(7.3%) | A(3) | B |
| Comparative 1 | T-26 | C (15) | C (18) | C | C | C(1.28) | C(18.4%) | D(14) | C |
| Comparative 2 | T-27 | C (17) | D (23) | C | D | D(1.12) | B(12.3%) | B(7) | B |
| Comparative 3 | T-28 | C (12) | C (15) | C | C | B(1.31) | C(15.8%) | D(17) | D |
| Comparative 4 | T-29 | D (21) | D (24) | D | D | B(1.31) | A(5.1%) | A(1) | B |
| Comparative 5 | T-30 | C (13) | C (16) | C | C | B(1.33) | C(17.3%) | D(15) | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-247458, filed Dec. 21, 2016, and Japanese Patent Application No. 2017-214362, filed Nov. 7, 2017 which are hereby incorporated by reference herein in their entirety.

What is claimed is:

1. A toner comprising a toner particle containing a binder material and a colorant;

the binder material comprising a resin composition A and a resin composition B, a mass ratio of resin composition A to resin composition B being from 30/70 to 70/30 and a softening point of resin composition B being at least 20° C. lower than a softening point of resin composition A; and the resin composition A comprising a hybrid resin having a polyester segment and a vinyl polymer segment, wherein a dE'/dT curve of storage elastic modulus E' with respect to temperature T obtained by powder dynamic viscoelastic measurement on the toner has a relative minimum values of equal to or less than $-1.00\times10^{7}$ in the temperature range of from 30° C. to 180° C., and a relative minimum value on the lowest temperature side of the relative minimum values is equal to or less than $-1.00\times10^{8}$, E'(50) is from $1.00\times10^{9}$ to $9.00\times10^{9}$, and $$1.50\leq[E(50)]/[E'(120)]\leq3.00$$

when E'(50) represents the storage elastic modulus E' of the toner at 50° C. and E'(120) represents the storage elastic modulus E' of the toner at 120° C.

2. The toner according to claim 1, wherein a content of an ethyl acetate-insoluble matter of the binder material after Soxhlet extraction using ethyl acetate for 18 hours is from 18.0 to 30.0 mass % with respect to the total mass of the binder material.

3. The toner according to claim 1, wherein a content of a tetrahydrofuran-insoluble matter of the binder material after Soxhlet extraction using tetrahydrofuran for 18 hours is from 4.0 to 10.0 mass % with respect to the total mass of the binder material.

4. The toner according to claim 1, wherein $$15.0\leq(\alpha-\beta)\leq25.0$$

when α mass % represents the content of the ethyl acetate-insoluble matter of the binder material with respect to the total mass of the binder material after extraction for 18 hours in the Soxhlet extraction of the toner using ethyl acetate, and β mass % represents the content of the tetrahydrofuran-insoluble matter of the binder material with respect to the total mass of the binder material after extraction for 18 hours in the Soxhlet extraction of the toner using tetrahydrofuran.

5. The toner according to claim 1, wherein at least one of the resin composition A and the resin composition B comprises a resin having a polyester structure.

6. The toner according to claim 1, wherein the resin composition A comprises:

a polyester resin having in a terminal at least one of an alcohol residue from a long-chain alkyl monoalcohol having an average number of carbons of from 27 to 50, and a carboxylic acid residue from a long-chain alkyl monocarboxylic acid having an average number of carbons of from 27 to 50; and an aliphatic hydrocarbon having an average number of carbons of from 27 to 50, the total content of the aliphatic hydrocarbon and the residue in the resin composition A being from 2.5 to 10.0 mass %.

7. The toner according to claim 1, wherein the resin composition B has not more than 10 mass % of molecular weights equal to or less than 1,000 in a molecular weight distribution measured by gel permeation chromatography.

8. The toner according to claim 1, wherein the resin composition B comprises:

a polyester resin having in a terminal at least one of an alcohol residue from a long-chain alkyl monoalcohol having an average number of carbons of from 25 to 102, and a carboxylic acid residue from a long-chain alkyl monocarboxylic acid having an average number of carbons of from 25 to 102; and an aliphatic hydrocarbon having an average number of carbons of from 25 to 102, and total content of the aliphatic hydrocarbon and the residue in the resin composition B being from 5.0 to 20.0 mass %.

9. The toner according to claim 1, wherein a mass ratio of the polyester segment to the vinyl polymer segment in the hybrid resin is from 80/20 to 98/2.

10. The toner according to claim 1, wherein the vinyl polymer segment comprises a monomer unit derived from a styrene monomer, and a monomer unit derived from an acrylic acid monomer and/or a methacrylic acid monomer, a ratio of the content of the monomer unit derived from the acrylic acid monomer and/or the methacrylic acid monomer being from 80 to 95 mol % with respect to a total monomer unit of the vinyl polymer segment.

11. The toner according to claim 1, wherein the polyester segment comprises a monomer unit derived from an ethylene oxide adduct on bisphenol A, a ratio of the content of the monomer unit derived from the ethylene oxide adduct on bisphenol A being from 10 to 50 mol % with respect to a total monomer unit of the polyester segment.

* * * * *